US009442401B2

(12) United States Patent
Sekido et al.

(10) Patent No.: US 9,442,401 B2
(45) Date of Patent: Sep. 13, 2016

(54) ELECTROPHOTOGRAPHIC PHOTOSENSITIVE MEMBER, PROCESS CARTRIDGE, ELECTROPHOTOGRAPHIC APPARATUS, AND IMIDE COMPOUND

(71) Applicant: CANON KABUSHIKI KAISHA, Tokyo (JP)

(72) Inventors: Kunihiko Sekido, Suntou-gun (JP); Masashi Nishi, Susono (JP); Kei Tagami, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/564,969

(22) Filed: Dec. 9, 2014

(65) Prior Publication Data

US 2015/0185632 A1 Jul. 2, 2015

(30) Foreign Application Priority Data

Dec. 26, 2013 (JP) ..... 2013-270571
Nov. 27, 2014 (JP) ..... 2014-240042

(51) Int. Cl.
*G03G 5/00* (2006.01)
*G03G 5/14* (2006.01)
*G03G 5/06* (2006.01)

(52) U.S. Cl.
CPC ..... *G03G 5/14* (2013.01); *G03G 5/0651* (2013.01); *G03G 5/142* (2013.01)

(58) Field of Classification Search
CPC ..... G03G 5/142
USPC ..... 430/60, 64
See application file for complete search history.

(56) References Cited

U.S. PATENT DOCUMENTS 3,979,350 A * 9/1976 Winter ..... C08G 73/00 525/426
7,820,780 B2 * 10/2010 Bender ..... C07D 209/48 528/226
7,871,747 B2 1/2011 Shimoyama et al.
2014/0377701 A1 12/2014 Okuda et al.
2014/0377703 A1 12/2014 Ogaki et al.

FOREIGN PATENT DOCUMENTS

EP 1 879 076 A2 1/2008
JP 2001-83726 A 3/2001
JP 2003-345044 A 12/2003
JP 2007-108670 A 4/2007
JP 2008-250082 A 10/2008

OTHER PUBLICATIONS

U.S. Appl. No. 14/568,043, filed Dec. 11, 2014, Inventor: Tagami, et al.

(Continued)

*Primary Examiner* — Mark A Chapman
(74) *Attorney, Agent, or Firm* — Fitzpatrick, Cella, Harper & Scinto

(57) ABSTRACT

An electrophotographic photosensitive member including: a support; an undercoat layer formed on the support; and a photosensitive layer formed on the undercoat layer. The undercoat layer contains a polymerized product of a composition containing a compound represented by formula (1).

12 Claims, 2 Drawing Sheets

(56) References Cited

OTHER PUBLICATIONS

U.S. Appl. No. 14/568,047, filed Dec. 11, 2014, Inventor: Nishi, et al.
Yamashita, et al. (eds.), "Crosslinking Agent Handbook", Taiseisha, Ltd., 1981, pp. 536-605.
Fujiyama, et al., "Development of New Electron Transport Material with High Drift Mobility", Journal of the Imaging Society of Japan, vol. 45, No. 6, 2000, pp. 521-525.
Fujiyama, et al., "Development of New Electron Transport Material with High Drift Mobility", Journal of the Imaging Society of Japan, vol. 45, No. 6, 2006, pp. 521-525.
European Search Report dated Apr. 29, 2015 in European Application No. 14198175.3.
Gianolio, et al., "Tethered Naphthalene Diimide Intercalators Enhance DNA Triplex Stability", Bioorganic and Medicinal Chemistry, vol. 9, 2001, pp. 2329-2334.

* cited by examiner

ELECTROPHOTOGRAPHIC PHOTOSENSITIVE MEMBER, PROCESS CARTRIDGE, ELECTROPHOTOGRAPHIC APPARATUS, AND IMIDE COMPOUND

BACKGROUND OF THE INVENTION

1. Field of the Invention

The present invention relates to an electrophotographic photosensitive member, a process cartridge and an electrophotographic apparatus each having the electrophotographic photosensitive member, and an imide compound.

2. Description of the Related Art

An electrophotographic photosensitive member containing an organic photoconductive material (charge generating material) is mainly used as an electrophotographic photosensitive member mounted on a process cartridge and an electrophotographic apparatus. The electrophotographic photosensitive member generally has a support and a photosensitive layer formed on the support. Further, an undercoat layer is formed between the support and the photosensitive layer in many cases.

In recent years, the requirement to the quality of an electrophotographic image has been steadily increasing. For example, the tolerance to positive ghosting has been becoming remarkably severe. The positive ghosting is a phenomenon in which the density of only the portion irradiated with light becomes deep, when the portion irradiated with light is a halftone image at the next rotation of the electrophotographic photosensitive member while forming one sheet of the image.

A technique of allowing an electron transport material to be contained in an undercoat layer is known as a technique of suppressing (reducing) such a ghosting phenomenon.

As a technique of allowing an electron transport material to be contained in an undercoat layer, for example, Japanese Patent Application Laid-Open No. 2001-83726 and Japanese Patent Application Laid-Open No. 2003-345044 disclose a technique of allowing an electron transport material such as a fluorenone compound derivative and an imide compound derivative to be contained in an undercoat layer.

As a result of investigations by the inventors, it has been found that the prior art still has room for improvement with respect to the suppression (reduction) of the positive ghosting, particularly the variation (deterioration) of the positive ghosting level before and after continuous image output.

SUMMARY OF THE INVENTION

An object of the present invention is to provide an electrophotographic photosensitive member in which positive ghosting is suppressed, and a process cartridge and an electrophotographic apparatus each having the electrophotographic photosensitive member. Further, another object of the present invention is to provide an imide compound which can suppress the positive ghosting.

As a result of extensive investigations, the inventors have found that the suppression of positive ghosting can be achieved at a high level by allowing a polymerized product of a compound having a specific structure to be contained in an undercoat layer of an electrophotographic photosensitive member.

That is, the present invention provides an electrophotographic photosensitive member including: a support; an undercoat layer formed on the support; and a photosensitive layer formed on the undercoat layer; wherein the undercoat layer contains a polymerized product of a composition containing an imide compound represented by the following formula (1), (1)

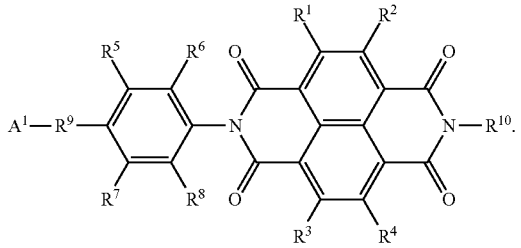

wherein $R^1$ to $R^4$ each independently represent a hydrogen atom, a cyano group, a nitro group, a halogen atom, a substituted or unsubstituted alkyl group, or a substituted or unsubstituted aryl group, $R^5$ to $R^8$ each independently represent a hydrogen atom, a halogen atom, a nitro group, or a substituted or unsubstituted alkyl group, $A^1$ represents a hydroxy group, a thiol group, an amino group, or a carboxy group, $R^9$ represents an unsubstituted or substituted alkylene group where the distance to $A^1$ is 2 to 6 atoms, a group where the distance to $A^1$ is 2 to 6 atom, which is derived from substitution of CONH for one of the $CH_2$'s in the main chain of an unsubstituted or substituted alkylene group, or a group where the distance to $A^1$ is 2 to 6 atoms, which is derived from substitution of $NR^{11}$ for one of the $CH_2$'s in the main chain of an unsubstituted or substituted alkylene group, a substituent of the substituted alkylene group is an alkyl group having 1 to 4 carbon atoms, $R^{11}$ represents an alkyl group, $R^{10}$ represents a group represented by $—R^{12}$-$A^2$, $A^2$ represents a hydroxy group, a thiol group, an amino group, or a carboxy group, $R^{12}$ represents an unsubstituted or substituted alkylene group where the distance to $A^2$ is 2 to 12 atoms, a group where the distance to $A^2$ is 2 to 12 atoms, which is derived from substitution of an oxygen atom for one of the $CH_2$'s in the main chain of an unsubstituted or substituted alkylene group, a group where the distance to $A^2$ is 2 to 12 atoms, which is derived from substitution of a sulfur atom for one of the $CH_2$'s in the main chain of an unsubstituted or substituted alkylene group, or a group where the distance to $A^2$ is 2 to 12 atoms, which is derived from substitution of $NR^{13}$ for one of the $CH_2$'s in the main chain of an unsubstituted or substituted alkylene group, a substituent of the substituted alkylene group is an alkyl group having 1 to 6 carbon atoms, a phenyl group, a benzyl group, or an alkoxycarbonyl group, and $R^{13}$ represents a hydrogen atom, or an alkyl group.

The present invention further provides a process cartridge detachably attachable to the main body of an electrophotographic apparatus, wherein the process cartridge integrally supports: the electrophotographic photosensitive member; and at least one device selected from the group consisting of a charging device, a developing device and a cleaning device.

The present invention further provides an electrophotographic apparatus having the electrophotographic photosensitive member, a charging device, an image exposure device, a developing device, and a transfer device.

The present invention further provides an imide compound represented by the above formula (1).

The present invention can provide an electrophotographic photosensitive member in which positive ghosting is suppressed, and a process cartridge and an electrophotographic apparatus each having the electrophotographic photosensitive member. The present invention can further provide an imide compound which can suppress the positive ghosting.

Further features of the present invention will become apparent from the following description of exemplary embodiments with reference to the attached drawings.

DESCRIPTION OF THE EMBODIMENTS

Figure 1:
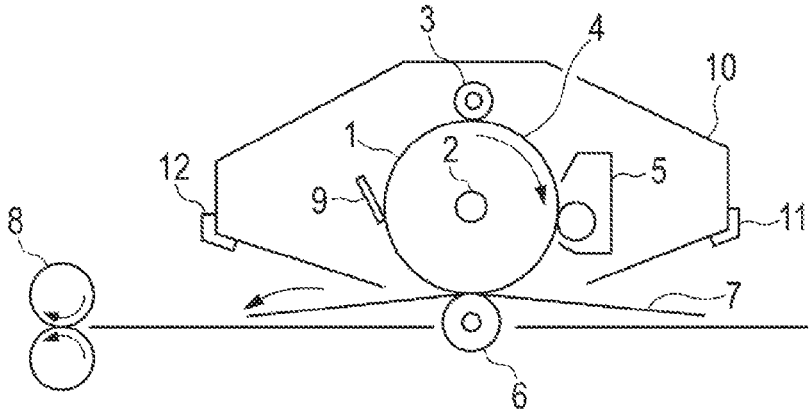
FIG. 1 is a diagram illustrating a schematic structure of an electrophotographic apparatus having a process cartridge provided with the electrophotographic photosensitive member of the present invention.

Preferred embodiments of the present invention will now be described in detail in accordance with the accompanying drawings.

The electrophotographic photosensitive member of the present invention has a support, an undercoat layer formed on the support, and a photosensitive layer containing a charge generating material and a hole transport material formed on the undercoat layer. The undercoat layer contains a polymerized product of a composition containing a compound (imide compound) represented by formula (1).

[Support]

A support can be a support having conductivity (electrically conductive support). Examples include a support made of metal, such as aluminum, nickel, copper, gold and iron, and a support made of an alloy. Examples further include a support in which a thin film of metal such as aluminum, silver and gold or a thin film of a conductive material such as indium oxide and tin oxide is formed on an insulating support such as polyester, polycarbonate, polyimide and glass.

The surface of the support may be subjected to electrochemical treatment such as anodic oxidation and treatment such as wet honing, a blast and cutting in order to improve electrical characteristics and suppress interference fringes which are easily generated during irradiation of coherent light such as a semiconductor laser.

[Undercoat Layer]

An undercoat layer is provided between a photosensitive layer and a support.

In the present invention, the undercoat layer on the support contains a polymerized product (cured product) of a composition containing an imide compound (electron transport material) represented by the following formula (1). Hereinafter, the imide compound represented by formula (1) may be referred to as a "naphthyldiimide compound."

(1)

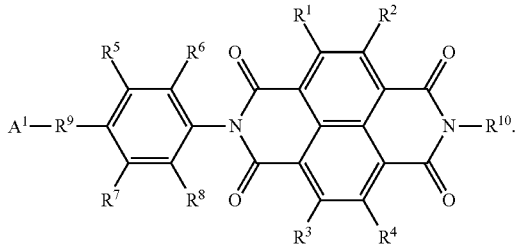

In formula (1), $R^1$ to $R^4$ each independently represent a hydrogen atom, a cyano group, a nitro group, a halogen atom, a substituted or unsubstituted alkyl group, or a substituted or unsubstituted aryl group, $R^5$ to $R^8$ each independently represent a hydrogen atom, a halogen atom, a nitro group, or a substituted or unsubstituted alkyl group, $A^1$ represents a hydroxy group, a thiol group, an amino group, or a carboxy group, $R^9$ represents an unsubstituted or substituted alkylene group where the distance to $A^1$ is 2 to 6 atoms, a group where the distance to $A^1$ is 2 to 6 atoms, which is derived from substitution of CONH for one of the $CH_2$'s in the main chain of an unsubstituted or substituted alkylene group, or a group where the distance to $A^1$ is 2 to 6 atoms, which is derived from substitution of $NR^{11}$ for one of the $CH_2$'s in the main chain of an unsubstituted or substituted alkylene group, a substituent of the substituted alkylene group is an alkyl group having 1 to 4 carbon atoms, $R^{11}$ represents an alkyl group, $R^{10}$ represents a group represented by —$R^{12}$-$A^2$, $A^2$ represents a hydroxy group, a thiol group, an amino group, or a carboxy group, $R^{12}$ represents an unsubstituted or substituted alkylene group where the distance to $A^2$ is 2 to 12 atoms, a group where the distance to $A^2$ is 2 to 12 atoms, which is derived from substitution of an oxygen atom for one of the $CH_2$'s in the main chain of an unsubstituted or substituted alkylene group, a group where the distance to $A^2$ is 2 to 12 atoms, which is derived from substitution of a sulfur atom for one of the $CH_2$'s in the main chain of an unsubstituted or substituted alkylene group, or a group where the distance to $A^2$ is 2 to 12 atoms, which is derived from substitution of $NR^{13}$ for one of the $CH_2$'s in the main chain of an unsubstituted or substituted alkylene group, a substituent of the substituted alkylene group is an alkyl group having 1 to 6 carbon atoms, a phenyl group, a benzyl group, or an alkoxycarbonyl group, and $R^{13}$ represents a hydrogen atom, or an alkyl group.

$R^9$ in formula (1) can represent an ethylene group, a propylene group or a butylene group.

Further, $R^{12}$ in formula (1) is preferably a substituted alkylene group where the distance to $A^2$ is 2 to atoms. The substituent of the substituted alkylene group is an alkyl group having 1 to 6 carbon atoms, a phenyl group, a benzyl group or an alkoxycarbonyl group.

Further, $A^1$ and $A^2$ in formula (1) is preferably a hydroxy group.

The undercoat layer can be formed by forming a coating film of a coating liquid for an undercoat layer containing a composition containing a compound represented by the above formula (1) and drying the coating film. The compound represented by the above formula (1) is polymerized during the drying of the coating film of the coating liquid for an undercoat layer, and the polymerization reaction (curing reaction) is accelerated by applying heat and light energy at this time.

In the present invention, the above composition containing a compound represented by formula (1) can contain a crosslinking agent. Further, the composition containing a compound represented by formula (1) can contain a crosslinking agent and a resin having a polymerizable functional group.

A compound which is polymerized (cured) or crosslinked with the compound represented by the above formula (1) can be used as a crosslinking agent. Specifically, a compound described in "Handbook of Crosslinking Agents" edited by Shinzo Yamashita and Tosuke Kaneko, published by Taiseisha Ltd. (1981) and the like can be used.

The mass ratio of a crosslinking agent to a compound represented by formula (1) can be, but not limited to, 100:50 to 100:250.

When the mass ratio is within the above range, the aggregation of crosslinking agents will be suppressed, and, as a result, the trap sites in the undercoat layer will be reduced, further improving a ghosting suppression effect. The content of the resin having a polymerizable functional group in the undercoat layer is preferably 3 to 60% by mass, more preferably 5 to 20% by mass based on the total mass of the composition of the undercoat layer.

Examples of the crosslinking agent include an isocyanate compound and an amine compound.

The isocyanate compound can be an isocyanate compound having a plurality of isocyanate groups or blocked isocyanate groups. Examples include tri-isocyanate benzene, tri-isocyanate methylbenzene, triphenylmethane tri-isocyanate, lysine tri-isocyanate, and, in addition, isocyanurate-modified products, biuret-modified products and allophanate-modified products of diisocyanate such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethyl hexamethylene diisocyanate, methyl-2,6-diisocyanate hexanoate and norbornane diisocyanate, and adduct-modified products of any of these diisocyanates with trimethylolpropane and pentaerythritol. Among these, the isocyanurate-modified products and the adduct-modified products are more preferred.

Examples of commercially available isocyanate compounds include Duranate MFK-60B and SBA-70B manufactured by Asahi Kasei Corporation and Desmodur BL3175 and BL3475 manufactured by Sumika Bayer Urethane Co., Ltd.

The amine compound can be, for example, an amine compound having a plurality of N-methylol groups or alkyl-etherified N-methylol groups. Examples include methylolated melamine, methylolated guanamine, a methylolated urea derivative, a methylolated ethyleneurea derivative, methylolated glycoluril, compounds in which the methylol part of these compounds is alkyl etherified, and derivatives thereof.

Examples of commercially available amine compounds include U-VAN 20SE60 and 220 manufactured by Mitsui Chemicals, Inc. and SUPER BECKAMINE L-125-60 and G-821-60 manufactured by DIC Corporation.

Examples other than isocyanate compounds and amine compounds include various compounds such as triglycidyl isocyanurate and 2,6-bis(hydroxymethyl)-p-cresol.

A resin having a polymerizable functional group that can be polymerized (cured) with a compound represented by formula (1) can be used as the resin. Examples of preferred polymerizable functional groups include a hydroxy group, a thiol group, an amino group, a carboxy group and a methoxy group. A resin having a structural unit represented by the following formula (2) is preferred as a thermoplastic resin having a polymerizable functional group.

(2)

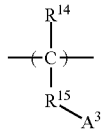

In formula (2), $R^{14}$ represents a hydrogen atom or an alkyl group. $R^{15}$ represent a single bond, an alkylene group or a phenylene group. $A^3$ represents a hydroxy group, a thiol group, an amino group or a carboxy group.

Examples of the resin having a structural unit represented by formula (2) include acetal resins, polyolefin resins, polyester resins, polyether resins, polyamide resins, and cellulosic resins. These resins each have a characteristic structure shown below in the structural unit represented by the above formula (2) or in addition to the structural unit represented by formula (2). The characteristic structures are shown in the following (E-1) to (E-6). (E-1) represents a structural unit of acetal resins. (E-2) represents a structural unit of polyolefin resins. (E-3) represents a structural unit of polyester resins. (E-4) represents a structural unit of polyether resins. (E-5) represents a structural unit of polyamide resins. (E-6) represents a structural unit of cellulosic resins.

(E-1)

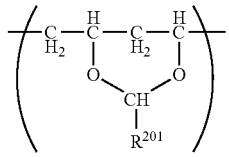

(E-2)

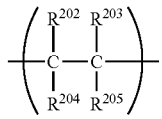

(E-3)

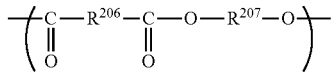

(E-4)

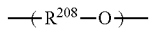

(E-5)

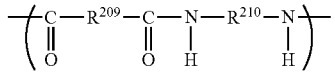

(E-6)

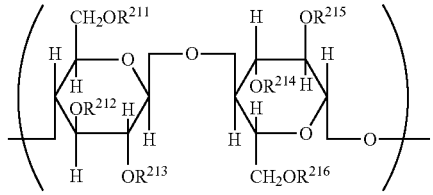

In the above formulae, $R^{201}$ to $R^{205}$ each independently represent a substituted or unsubstituted alkyl group, a substituted or unsubstituted aryl group or a hydrogen atom. $R^{206}$ to $R^{210}$ represent a substituted or unsubstituted alkylene group or a substituted or unsubstituted arylene group. When $R^{201}$ is $C_3H_7$, (E-1) represents butyral. $R^{211}$ to $R^{216}$ represent an acetyl group, a hydroxyethyl group, a hydroxypropyl group or a hydrogen atom.

The resin having a structural unit represented by formula (2) is obtained, for example, by polymerizing a monomer having a polymerizable functional group available from Sigma-Aldrich Japan, K.K. and Tokyo Chemical Industry Co., Ltd.

The resin having a structural unit represented by formula (2) can also be commercially available. Examples of available resins include polyether polyol resins such as AQD-457 and AQD-473 manufactured by Nippon Polyurethane Industry Co., Ltd. and SANNIX GP-400 and GP-700 manufactured by Sanyo Chemical Industries, Ltd.; polyester polyol resins such as PHTHALKYD W2343 manufactured by Hitachi Chemical Co., Ltd., WATERSOL S-118 and CD-520 and BECKOLITE M-6402-50 and M-6201-40IM manufactured by DIC Corporation, HARIDIP WH-1188 manufactured by Harima Chemicals Inc., and ES3604 and ES6538 manufactured by Japan U-Pica Co., Ltd.; polyacrylic polyol resins such as BURNOCK WE-300 and WE-304 manufactured by DIC Corporation; polyvinyl alcohol resins such as Kuraray Poval PVA-203 manufactured by Kuraray Co., Ltd.; polyvinyl acetal resins such as BX-1 and BM-1 manufactured by Sekisui Chemical Co., Ltd.; polyamide resins such as TORESIN FS-350 manufactured by Nagase ChemteX Corporation; carboxy group-containing resins such as AQUALIC manufactured by Nippon Shokubai Co., Ltd. and FINELEX SG2000 manufactured by Namariichi Co., Ltd.; polyamine resins such as LUCKAMIDE manufactured by DIC Corporation; and polythiol resins such as QE-340M manufactured by Toray Industries Inc. Among these resins, polyvinyl acetal resins, polyester polyol resins, and the like are more preferable in terms of polymerizability and uniformity of an electron transport layer.

The weight average molecular weight (Mw) can be in the range of 600 to 400,000.

Examples of the determination method of the polymerizable functional group in resin include the following methods: titration of the carboxy group with potassium hydroxide, titration of the amino group with sodium nitrite, titration of the hydroxy group with acetic anhydride and potassium hydroxide, and titration of the thiol group with 5,5'-dithiobis (2-nitrobenzoic acid). There is also a calibration curve method obtained from the IR spectra of samples in which the ratio of introducing a polymerizable functional group has been changed.

Table 1 shows specific examples of the resin having a structural unit represented by the above formula (2). In Table 1, the column of "Characteristic part" shows the structural unit represented by any of the above (E-1) to (E-5).

TABLE 1

| | Structure | | | Number of moles of functional groups | Characteristic | Molecular |
|---|---|---|---|---|---|---|
| | $R^{14}$ | $R^{15}$ | $A^3$ | per 1 g | moiety | weight |
| B1 | H | Single bond | OH | 3.3 mmol | Butyral | $1 \times 10^5$ |
| B2 | H | Single bond | OH | 3.3 mmol | Butyral | $4 \times 10^4$ |

TABLE 1-continued

| | Structure | | | Number of moles of functional groups | Characteristic | Molecular |
|---|---|---|---|---|---|---|
| | $R^{14}$ | $R^{15}$ | $A^3$ | per 1 g | moiety | weight |
| B3 | H | Single bond | OH | 3.3 mmol | Butyral | $2 \times 10^4$ |
| B4 | H | Single bond | OH | 1.0 mmol | Polyolefin | $1 \times 10^5$ |
| B5 | H | Single bond | OH | 3.0 mmol | Polyester | $8 \times 10^4$ |
| B6 | H | Single bond | OH | 2.5 mmol | Polyether | $5 \times 10^4$ |
| B7 | H | Single bond | OH | 2.8 mmol | Cellulose | $3 \times 10^4$ |
| B8 | H | Single bond | COOH | 3.5 mmol | Polyolefin | $6 \times 10^4$ |
| B9 | H | Single bond | $NH_2$ | 1.2 mmol | Polyamide | $2 \times 10^5$ |
| B10 | H | Single bond | SH | 1.3 mmol | Polyolefin | $8 \times 10^3$ |
| B11 | H | Phenylene | OH | 2.8 mmol | Polyolefin | $6 \times 10^4$ |
| B12 | H | Single bond | OH | 3.0 mmol | Butyral | $7 \times 10^4$ |
| B13 | H | Single bond | OH | 2.9 mmol | Polyester | $2 \times 10^4$ |
| B14 | H | Single bond | OH | 2.5 mmol | Polyester | $6 \times 10^3$ |
| B15 | H | Single bond | OH | 2.7 mmol | Polyester | $8 \times 10^4$ |
| B16 | H | Single bond | COOH | 1.4 mmol | Polyolefin | $2 \times 10^5$ |
| B17 | H | Single bond | COOH | 2.2 mmol | Polyester | $9 \times 10^3$ |
| B18 | H | Single bond | COOH | 2.8 mmol | Polyester | $8 \times 10^2$ |
| B19 | $CH_3$ | $CH_2$ | OH | 2.0 mmol | Polyester | $5 \times 10^3$ |
| B20 | $C_2H_5$ | Single bond | OH | 1.2 mmol | Polyolefin | $6 \times 10^2$ |
| B21 | H | Single bond | OH | 3.3 mmol | Butyral | $2.7 \times 10^5$ |
| B22 | H | Single bond | OH | 3.3 mmol | Butyral | $4 \times 10^5$ |
| B23 | H | Single bond | OH | 2.5 mmol | Acetal | $4 \times 10^5$ |

The undercoat layer may contain other materials such as a resin, organic particles, inorganic particles and a leveling agent in addition to the polymerized product containing the compound represented by formula (1), in order to improve film formability and electrical characteristics. However, the content of these materials in the undercoat layer is preferably less than 50% by mass, more preferably less than 20% by mass based on the total mass of the undercoat layer.

The reason why the electrophotographic photosensitive member having an undercoat layer of the present invention is excellent in ghosting suppression is estimated by the inventors as follows.

When a polymerizable material is employed in an undercoat layer, there are many advantages including improvement in solvent resistance. However, particularly when electrons are intended to be transported by intermolecular hopping using an electron transport material, the flexibility of molecular structure is reduced. Therefore, the delivery of electrons is liable to be reduced. This phenomenon is remarkable during the continuous output in which electrons must be transported continuously.

However, in the case of the undercoat layer in which an electron transport material of the present invention is used, the electron transport material is present uniformly without uneven distribution, and the flexibility of molecular structure is not reduced. Therefore, the delivery of electrons is estimated to be improved. This will probably result in an effect of suppressing the ghosting caused by the stagnation of electrons.

An aromatic ring is directly bonded to one side of the naphthyldiimide ring of the imide compound used for the undercoat layer of the present invention, and the aromatic ring is estimated to be present not on the same plane as that of the naphthyldiimide ring. Accordingly, the imide compound has a properly bulky, large volume, which will probably suppress the aggregation and uneven distribution of the naphthyldiimide rings.

The hydroxy group, thiol group, amino group or carboxy group (hereinafter, may be generically referred to as a polymerizable functional group) is bonded to the naphthyldiimide ring having a rigid structure and the aromatic ring which is directly bonded to the naphthyldiimide ring via an aliphatic chain having a chain length of 2 or more. This will probably enable the flexibility of molecular structure to be maintained also after polymerization.

Further, the polymerizable functional group bonded to the aromatic ring directly bonded to the naphthyldiimide ring via an aliphatic chain having a chain length of 2 or more is positioned at a distant place (para position) relative to the naphthyldiimide ring and can be present apart from the moiety that polymerizes with a crosslinking agent or the like as compared with an ortho position/meta position. This also will probably be one of the reasons that can maintain flexibility. It is conceivable that the stagnation of electrons will be significantly reduced for these reasons, thus producing a ghosting suppression effect at a higher level.

Specific examples of naphthyldiimide compounds to be used in the present invention will be shown below, but the present invention is not limited to these examples.

TABLE 2

E101

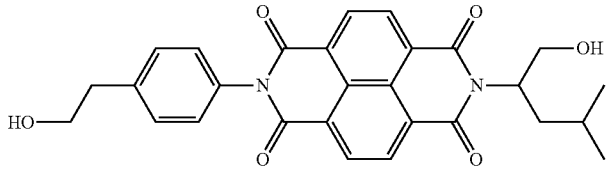

E102

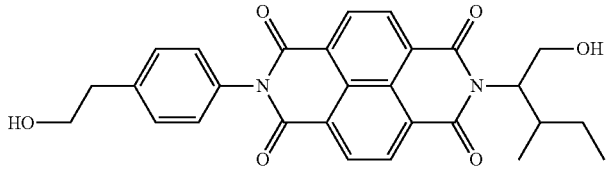

E103

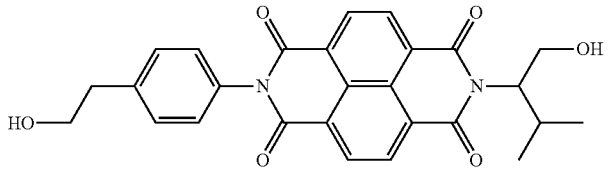

E104

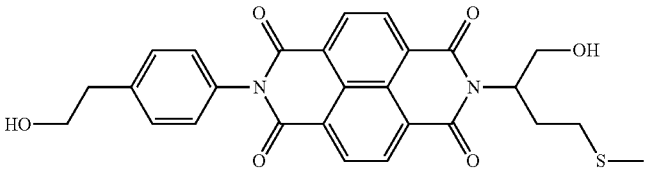

E105

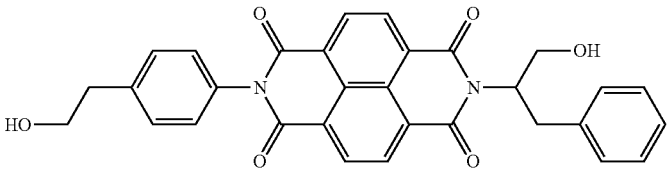

E106

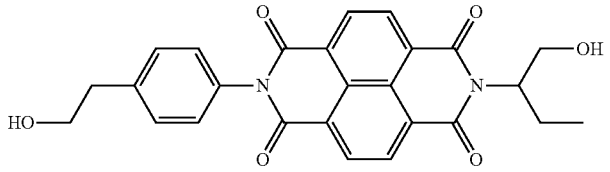

E107

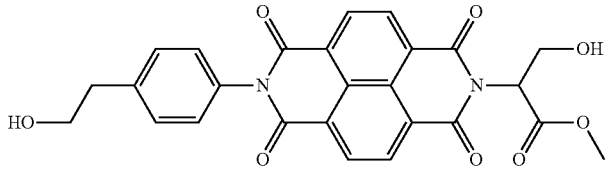

TABLE 2-continued
| | |
|---|---|
| E108 | 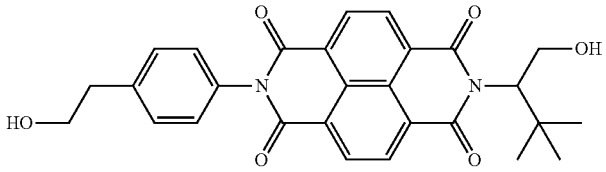 |
| E109 | 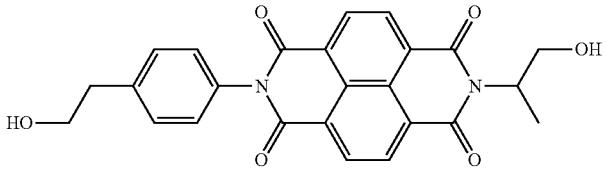 |
| E110 | 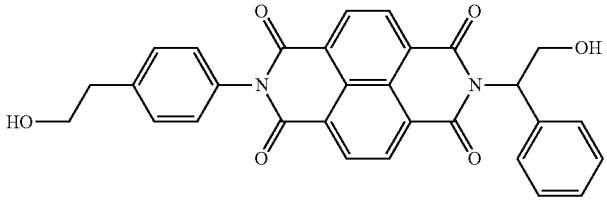 |
TABLE 3
| | |
|---|---|
| E111 | 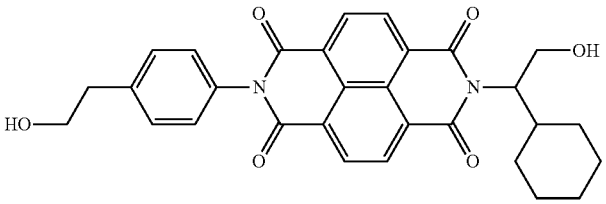 |
| E112 | 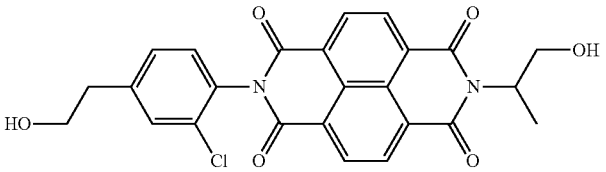 |
| E113 | 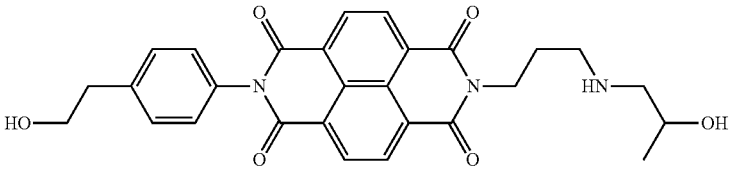 |
| E114 | 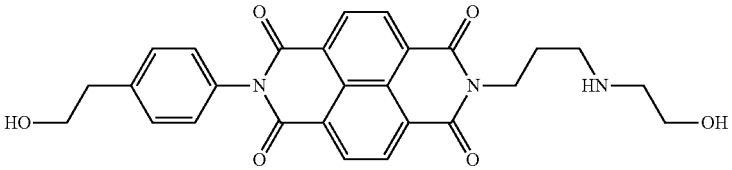 |
| E115 | 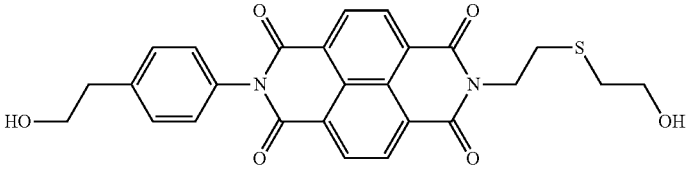 |

TABLE 3-continued
| | |
|---|---|
| E116 | 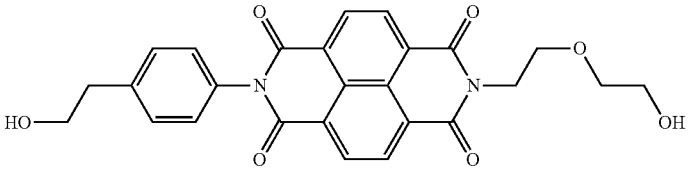 |
| E117 | 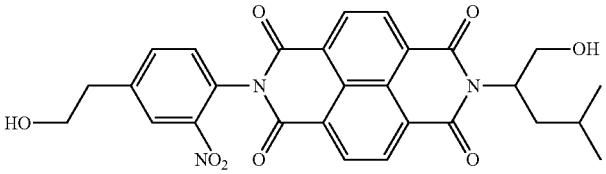 |
| E118 | 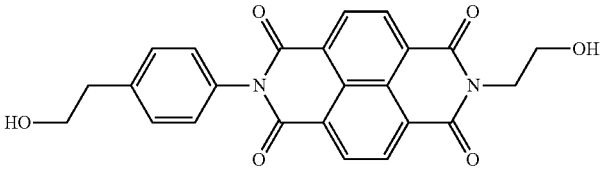 |
| E119 | 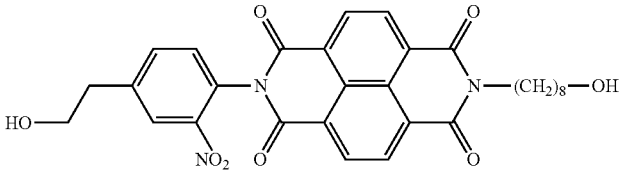 |
| E120 | 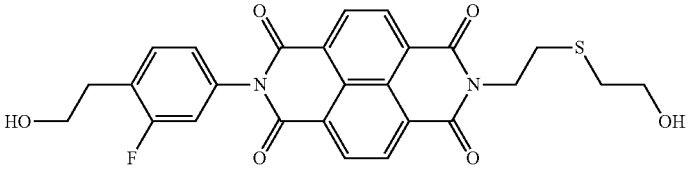 |
TABLE 4
| | |
|---|---|
| E121 | 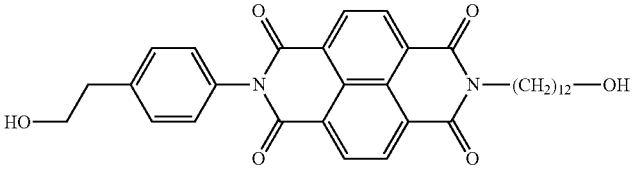 |
| E122 | 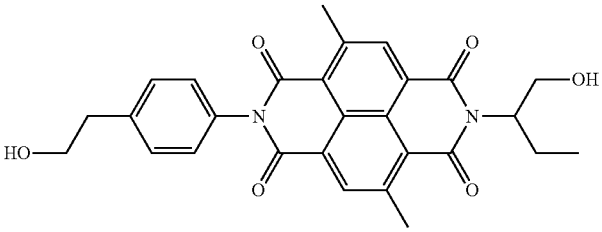 |
| E123 | 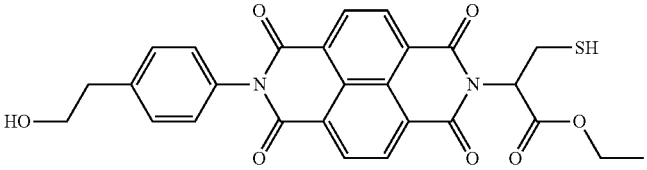 |

TABLE 4-continued
E124
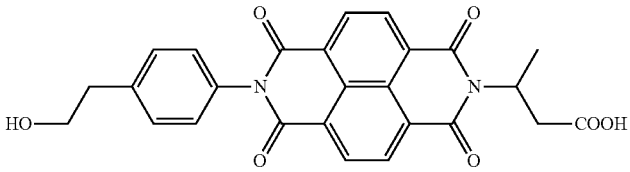
E125
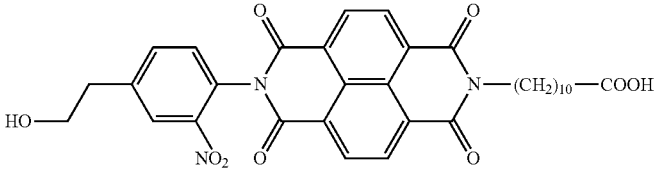
E126
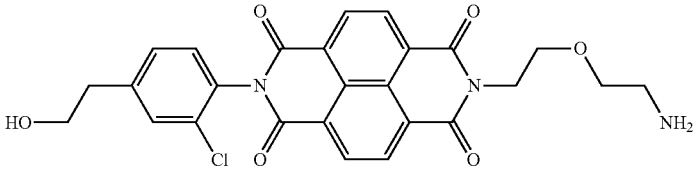
E127
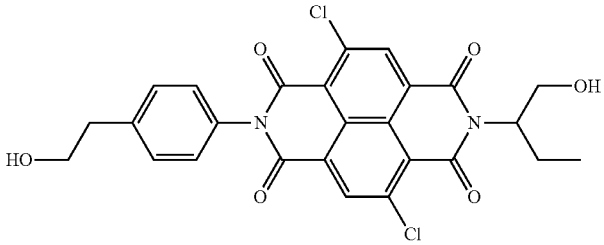
E128
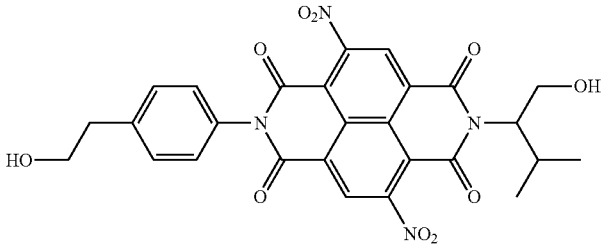
E129
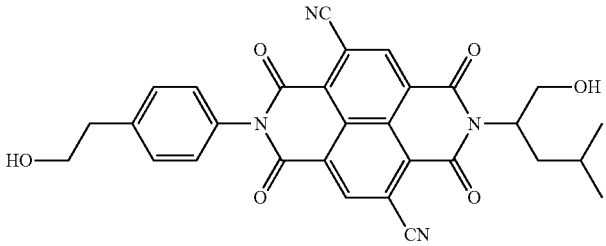
E130
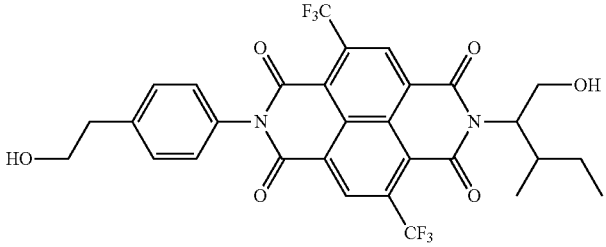

TABLE 5
E131
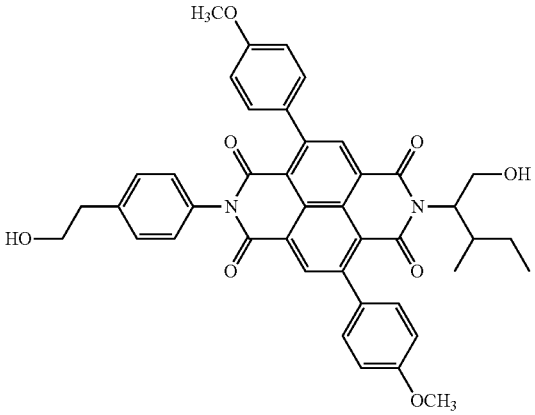
E132
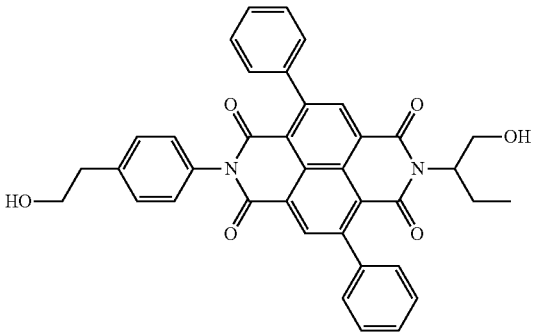
E133
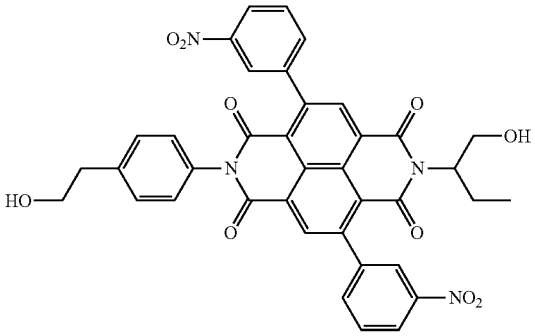
E134
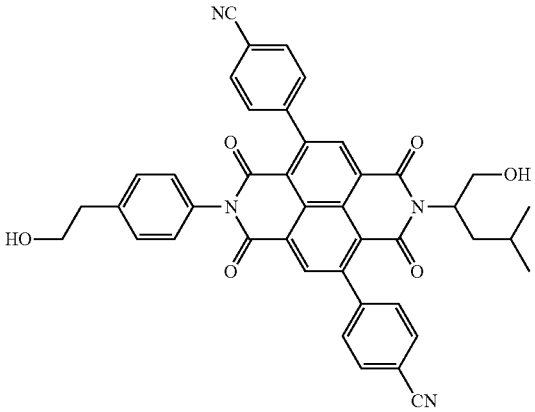
TABLE 6
E135
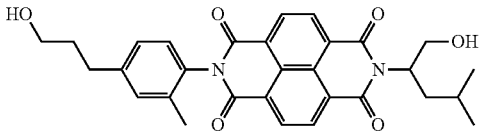
E136
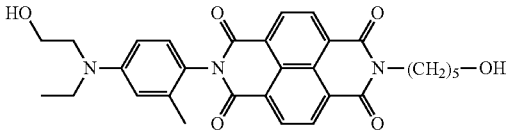
E137
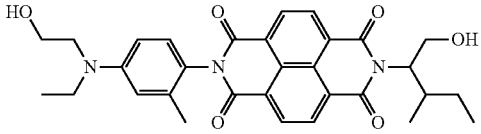
E138
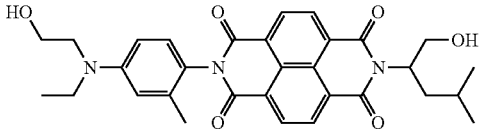
E139
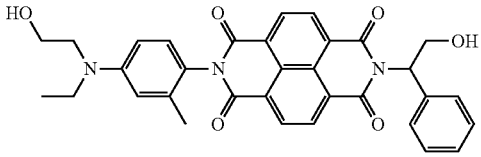
E140
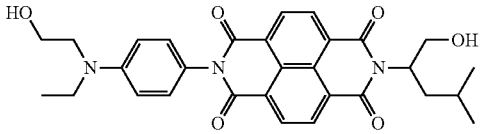

TABLE 7
E141
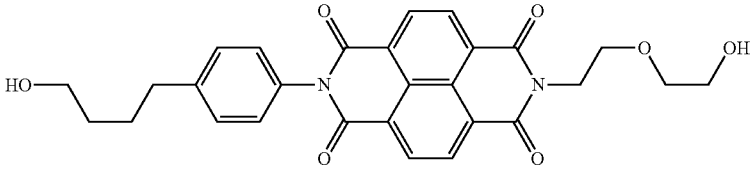
E142
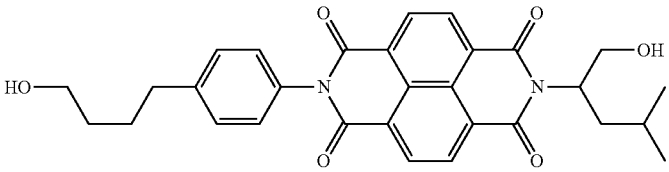
E143
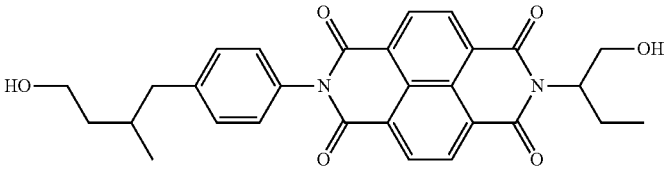
E144
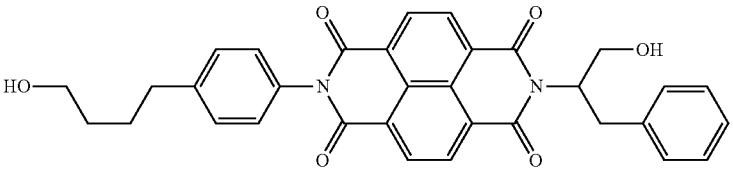
E145
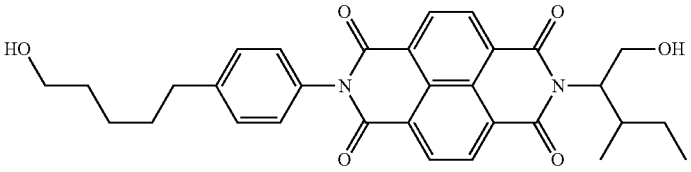
E146
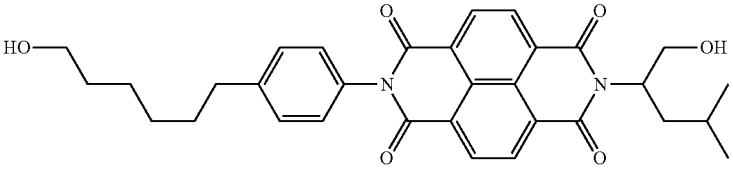
TABLE 8
E201
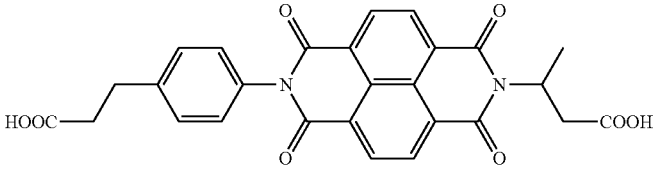
E202
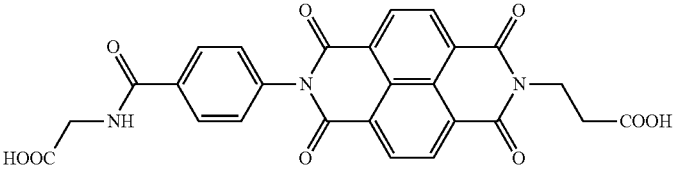

TABLE 8-continued
E203
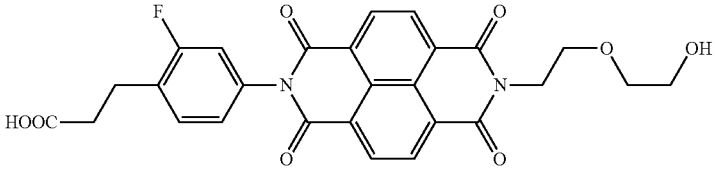
E204
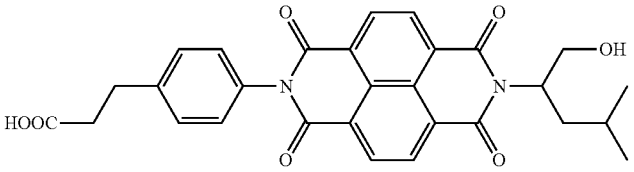
E205
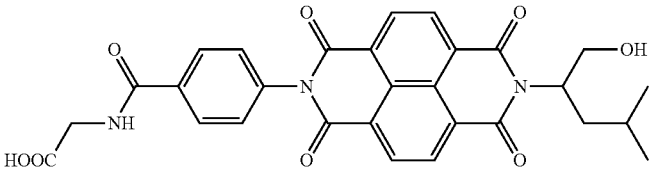
E206
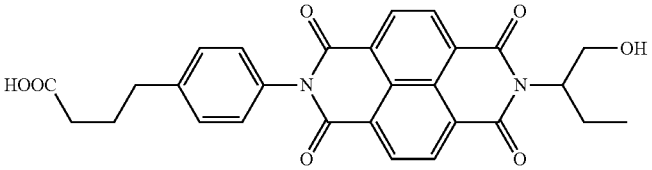
E207
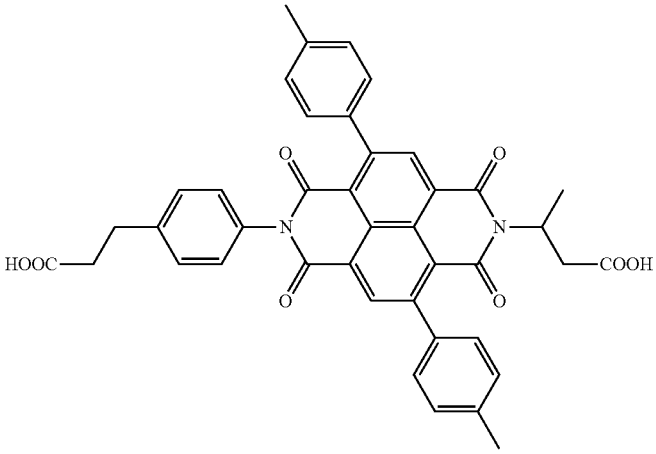
E208
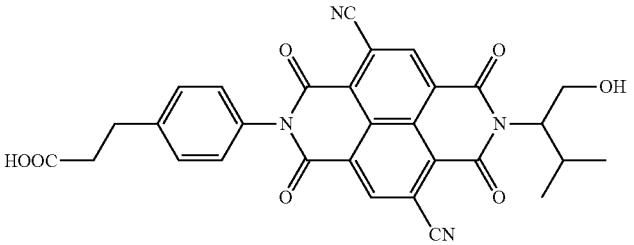

TABLE 9
E301
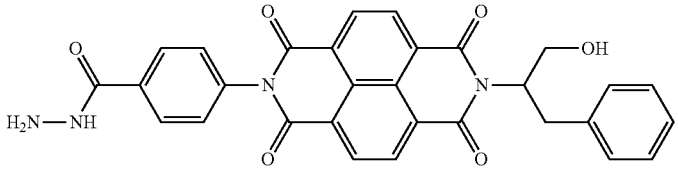
E302
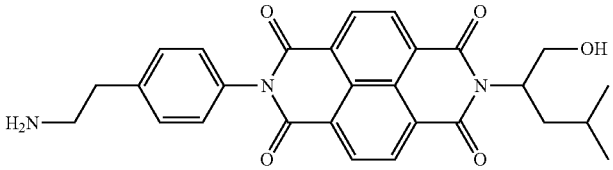
E303
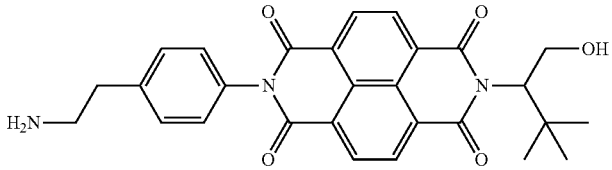
E304
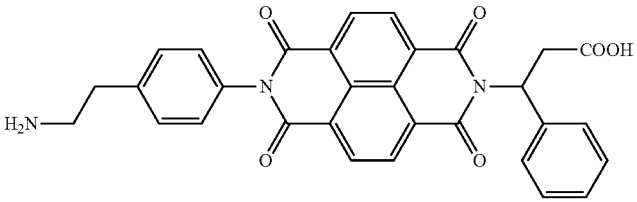
E305
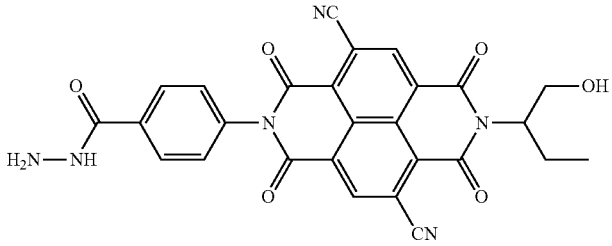
E306
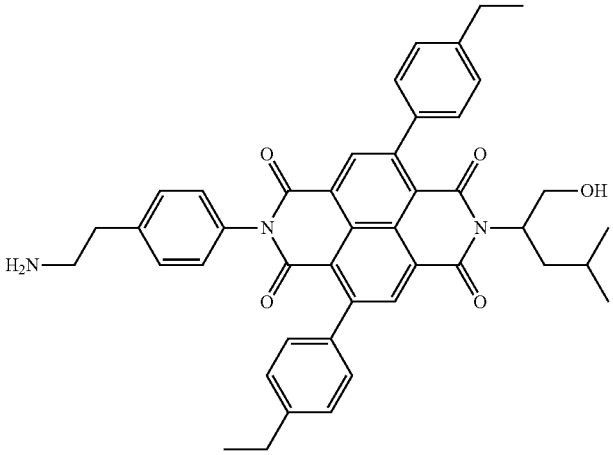

TABLE 10

E401

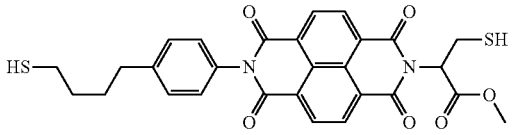

E402

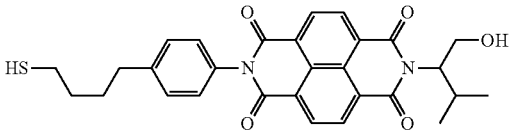

E403

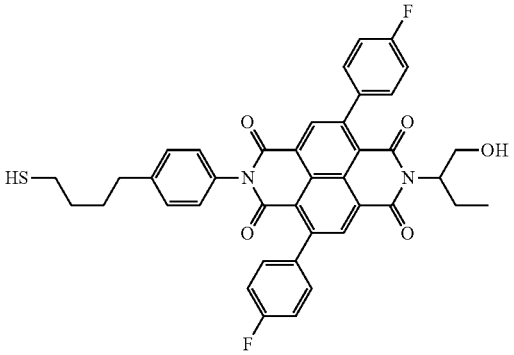

E404

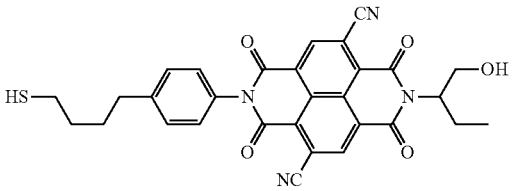

The derivatives having a structure represented by formula (1) can be synthesized by known synthetic methods described, for example, in Japanese Patent Application Laid-Open No. 2007-108670 and Journal of the Imaging Society of Japan 45 (6), 521-525 (2006). For examples, the derivatives can be synthesized by a reaction of naphthalenetetracarboxylic dianhydride with a monoamine derivative, which are commercially available from Tokyo Chemical Industry Co., Ltd., Sigma-Aldrich Japan K.K. and Johnson Matthey Japan Incorporated. Two types of monoamines may be added simultaneously or separately during the reaction.

Examples of the solvent used for the synthesis include known solvents such as NN-dimethylformamide, NN-dimethylacetamide, 1,3-dimethyl-2-imidazolidinone, N-methyl-2-pyrrolidone, dimethyl sulfoxide, imidazole, and N-methylimidazole. The reaction can also be performed without a solvent. In the synthesis, a known catalyst may be added, such as a metal-based catalyst such as zinc acetate and an organic catalyst such as triethylamine and pyridine. When a reaction product obtained in the reaction is purified, a known purification method can be used, such as column chromatography, recrystallization, reprecipitation, treatment with an adsorbent, sublimation and distillation.

Further, two methods can be used to introduce a polymerizable functional group (a hydroxy group, a thiol group, an amino group and a carboxy group) into a derivative having a structure represented by formula (1). A first method includes a method of directly introducing any of these polymerizable functional groups into a derivative having a structure represented by formula (1). A second method includes a method of introducing a structure having a polymerizable functional group or a functional group that can be a precursor of a polymerizable functional group into a derivative having a structure represented by formula (1). Specifically, the second method includes a method of subjecting a halide of a derivative having a structure represented by formula (1) to a cross-coupling reaction using a palladium catalyst and a base to introduce a functional group-containing aryl group. Another method includes a method of subjecting a halide of a derivative having a structure represented by formula (1) to a cross-coupling reaction using a $FeCl_3$ catalyst and a base to introduce a functional group-containing alkyl group. Another method includes a method of subjecting a halide of a derivative having a structure represented by formula (1) to lithiation followed by allowing an epoxy compound or $CO_2$ to act on the lithiated compound to introduce a hydroxyalkyl group or a carboxy group, respectively.

The compounds and the like used in the present invention have been confirmed by the following methods.

Mass Spectrometry

A matrix-assisted laser desorption/ionization time-of-flight mass spectrometer (MALDI-TOF MS: ultraflex manufactured by Bruker Daltonics Inc.) was used. Conditions including accelerating voltage: 20 kV, mode: Reflector, and reference standard of molecular weight: fullerene $C_{60}$ were used, and the molecular weight was confirmed by the resulting peak top value.

Nuclear Magnetic Resonance Spectroscopic Analysis

The structure was confirmed by the $^1$H-NMR spectrum in deuterated chloroform ($CDCl_3$) using a Fourier transform nuclear magnetic resonance apparatus (FT-NMR: AVANCEIII500 manufactured by Bruker BioSpin K.K.).

[Photosensitive Layer]

A photosensitive layer containing a charge generating material and a hole transport material is provided on the undercoat layer.

The photosensitive layer containing a charge generating material and a hole transport material includes two types of photosensitive layers: a photosensitive layer in which a charge generating layer containing a charge generating material and a hole transport layer containing a hole transport material are laminated in this order from the support side (hereinafter also referred to as a "lamination type photosensitive layer") and a photosensitive layer in which a charge generating material and a hole transport material are contained in the same layer (hereinafter also referred to as a "monolayer type photosensitive layer"). A plurality of charge generating layers and electron hole transport layers may be provided, respectively.

Examples of the charge generating material include an azo pigment, a perylene pigment, a quinone pigment, an indigoid pigment, a phthalocyanine pigment, and a perinone pigment. Among these, an azo pigment and a phthalocyanine pigment are preferred. Among the phthalocyanine pigment, oxy-titanium phthalocyanine, chlorogallium phthalocyanine, and hydroxygallium phthalocyanine are preferred.

When the photosensitive layer is a lamination type photosensitive layer, examples of a binder resin used for the charge generating layer include polymers and copolymers of vinyl compounds such as styrene, vinyl acetate, vinyl chloride, acrylic esters, methacrylates, vinylidene fluoride, and trifluoroethylene, polyvinyl alcohol, polyvinyl acetal, polycarbonate, polyester, polysulfone, polyphenylene oxide, polyurethane, cellulosic resins, phenol resins, melamine resins, silicone resins and epoxy resins. Among these, polyester, polycarbonate and polyvinyl acetal are preferred, and among these, polyvinyl acetal is more preferred.

In the charge generating layer, the mass ratio of the charge generating material to the binder resin (charge generating material/binder resin) is preferably in the range of 10/1 to 1/10, more preferably in the range of 5/1 to 1/5.

The thickness of the charge generating layer can be 0.05 μm or more and 5 μm or less.

Examples of the hole transport material include polycyclic aromatic compounds, heterocyclic compounds, hydrazone compounds, styryl compounds, benzidine compounds, triarylamine compounds and triphenylamine. Examples of the hole transport material further include polymers each having a group derived from these compounds on the main chain or side chain.

When the photosensitive layer is a lamination type photosensitive layer, examples of the binder resin used for the hole transport layer include polyester, polycarbonate, polymethacrylates, polyarylate, polysulfone and polystyrene. Among these, polycarbonate and polyarylate are preferred. Further, the weight average molecular weight (Mw) thereof can be in the range of 10,000 to 300,000.

In the hole transport layer, the mass ratio of the hole transport material to the binder resin (hole transport material/binder resin) is preferably in the range of 10/5 to 5/10, more preferably in the range of 10/8 to 6/10.

Note that other layers such as a conductive layer in which conductive particles such as a metal oxide and carbon black are dispersed in a resin and a second undercoat layer which does not contain a polymerized product used in the present invention may be provided between a support and the undercoat layer or between the undercoat layer and a photosensitive layer.

Further, a protective layer containing conductive particles or a hole transport material and a binder resin may be provided on a photosensitive layer (or on a hole transport layer in the case of a lamination type photosensitive layer). The protective layer may further contain an additive such as a lubricant. Further, the resin (binder resin) itself of the protective layer may be imparted with conductivity and hole transportability, and in this case, the protective layer may contain no conductive particles and hole transport materials other than the resin. Further, the binder resin of the protective layer may be a thermoplastic resin or a curable resin to be cured by heat, light, radiation (such as electron beams) or the like.

A method of forming each layer such as an undercoat layer and a photosensitive layer included in the electrophotographic photosensitive member can be a method of applying a coating liquid obtained by dissolving and/or dispersing materials included in each layer in a solvent and drying and/or curing the resulting coating film, thereby forming the layers. Examples of the method of applying the coating liquid include a dip coating method (an immersion coating method), a spray coating method, a curtain coating method and a spin coating method. Among these, the dip coating method is preferred in terms of efficiency and productivity.

[Process Cartridge and Electrophotographic Apparatus]

FIG. 1 illustrates a schematic structure of an electrophotographic apparatus having a process cartridge provided with the electrophotographic photosensitive member of the present invention.

In FIG. 1, reference numeral 1 denotes a drum-shaped electrophotographic photosensitive member of the present invention, which is rotated at a predetermined circumferential speed in the arrow direction about a rotating shaft 2. The surface (circumferential surface) of the electrophotographic photosensitive member 1 is charged to a predetermined positive or negative potential by a charging device 3 (for example, a contact-type primary charger, a non-contact type primary charger or the like) in the course of rotation. Then, exposure light (image exposure light) 4 (for example, laser light) from an image exposure device (not shown) such as slit exposure and laser beam scanning exposure is received. In this way, an electrostatic latent image is successively formed on the surface of the electrophotographic photosensitive member 1.

The electrostatic latent image formed is then developed with a toner in a developing device 5 (for example, a contact-type developing device, a non-contact-type developing device or the like). The resulting toner image is successively transferred to a transfer material 7 (for example, paper) by a transfer device 6. The transfer material 7 is taken out from a transfer material feed part (not shown) synchronously with the rotation of the electrophotographic photosensitive member 1 and fed to between the electrophotographic photosensitive member 1 and the transfer device 6 (for example, transfer charging device).

The transfer material 7 on which the toner image has been transferred is separated from the surface of the electrophotographic photosensitive member 1, introduced into a fixing device 8 to be subjected to image fixation, and is thereby printed out of the electrophotographic apparatus as a reproduction (copy).

The surface of the electrophotographic photosensitive member 1 after toner transfer is subjected to removal of residual toner after transfer by a cleaning device 9 to be cleaned, further subjected to charge elimination treatment with pre-exposure light from a pre-exposure device (not shown), and then repeatedly used for image formation.

As the charging device 3, a scorotron charger or a corotron charger utilizing corona discharge may be used, or a contact-type charger equipped with a charging member having a roller shape, a blade shape, a brush shape or the like may be used.

In the present invention, at least one device selected from the components such as the charging device 3, the developing device 5, the transfer device 6 and the cleaning device 9 may be integrally combined with the electrophotographic photosensitive member 1 to form a process cartridge. Then, the process cartridge may be designed to be detachably attachable to the main body of an electrophotographic apparatus such as a copying machine and a laser beam printer. For example, at least one device selected from the group consisting of the charging device 3, the developing device 5 and the cleaning device 9 is integrally supported together with the electrophotographic photosensitive member 1 to form a cartridge. Then, a guiding device such as rails 11 and 12 of the main body of the electrophotographic apparatus is used to form a process cartridge 10 which is detachably attachable to the main body of the electrophotographic apparatus.

EXAMPLE

Hereinafter, the present invention will be described in more detail by way of Examples. Note that "parts" in Examples means "parts by mass".

First, Synthesis Example of the imide compound represented by formula (1) will be described.

Synthesis Example

Into a 300-ml three-necked flask, 26.8 g (100 mmol) of 1,4,5,8-naphthalenetetracarboxylic dianhydride and 150 ml of dimethylacetamide were charged under a nitrogen flow at room temperature. Thereto, a mixture of 6.9 g (50 mmol) of 2-(4-aminophenyl)ethanol, 5.9 g (50 mmol) of L-leucinol, and 50 ml of dimethylacetamide was dropwise added with stirring. After completion of dropwise adding, the resulting mixture was refluxed under heating for 6 hours. After completion of reaction, the container was cooled, and the mixture was concentrated under reduced vacuum. Ethyl acetate was added to the residue followed by filtration, and the filtrate was purified by silica gel column chromatography. The recovered material was recrystallized from ethyl acetate/hexane to obtain 15.0 g of the imide compound represented by formula (E101) shown in Table 2.

Figure 4:
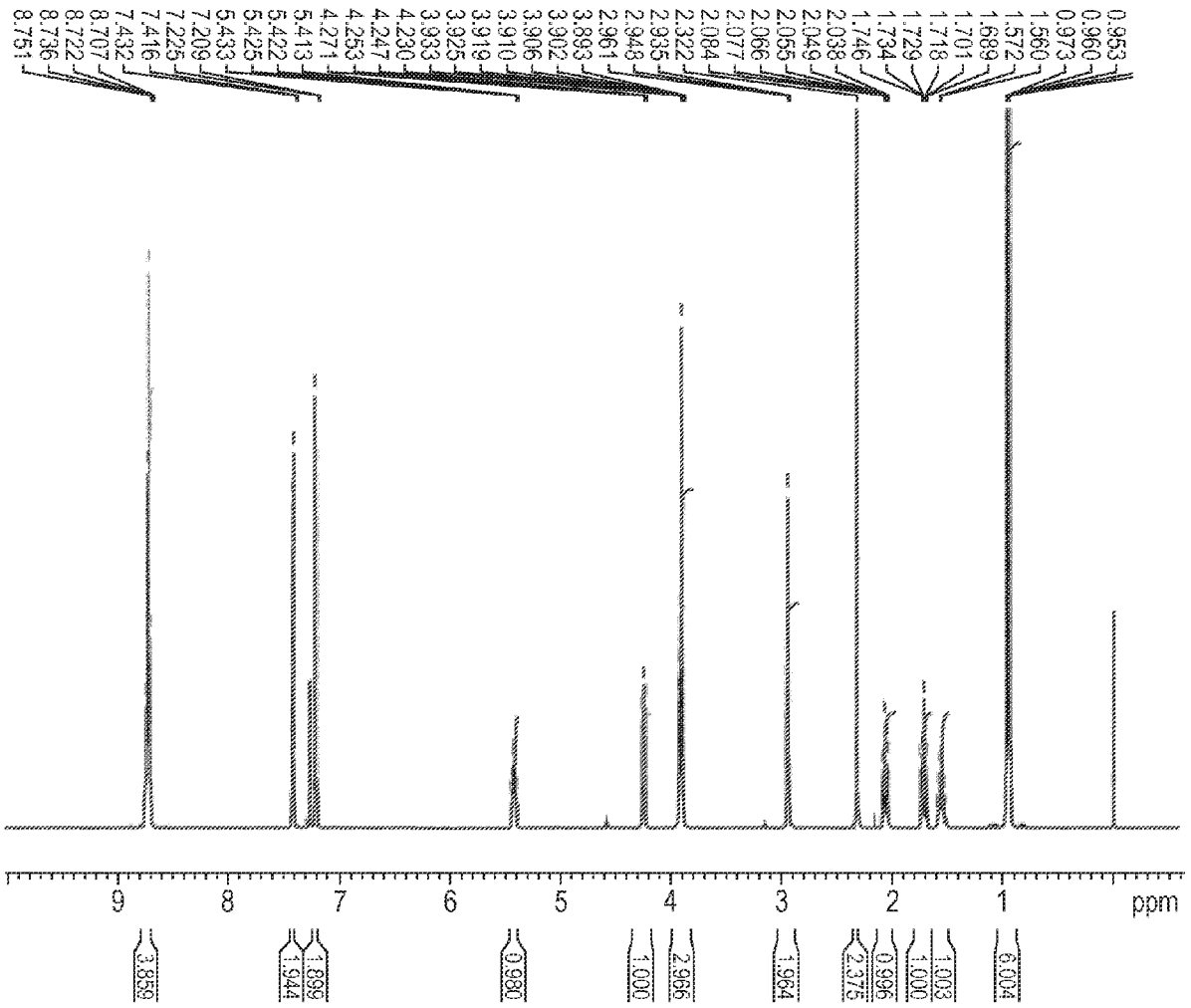
FIG. 4 is a diagram illustrating a $^1$H-NMR spectrum of the compound of Synthesis Example 1.

Note that the H-NMR spectrum obtained by measuring this compound with a nuclear magnetic resonance apparatus is shown in FIG. 4. The imide compounds of the present invention other than the imide compound represented by formula (E101) can also be synthesized in the same manner as described above by selecting raw materials corresponding to the structure of the imide compounds.

Next, production and evaluation of the electrophotographic photosensitive member will be described below.

Example 1

An aluminum cylinder (JIS-A3003, aluminum alloy) having a length of 260.5 mm and a diameter of 30 mm was used as a support (electrically conductive support).

Next, 50 parts of titanium oxide particles coated with oxygen-deficient tin oxide (powder resistivity: 120 Ω·cm, coverage of tin oxide: 40%), 40 parts of a phenolic resin (PLYOPHEN J-325, manufactured by DIC Corporation, resin solid content: 60%) and 55 parts of methoxypropanol were charged into a sand mill containing glass beads having a diameter of 1 mm and subjected to dispersion treatment for 3 hours to prepare a coating liquid for a conductive layer.

The average particle size of the titanium oxide particles coated with oxygen-deficient tin oxide in the coating liquid for a conductive layer was measured with a particle size distribution analyzer manufactured by Horiba, Ltd. (trade name: CAPA700) by a centrifugal sedimentation method at a rotation speed of 5,000 rpm using tetrahydrofuran as a dispersion medium. As a result, the average particle size was found to be 0.30 μm.

The coating liquid for a conductive layer was applied to the support by dip coating, and the resulting coating film was dried and heat-cured at 160° C. for 30 minutes, thereby forming a conductive layer having a thickness of 18 μm.

Next, 1 part of the compound (E101), 0.2 parts of the resin represented by B23, and 0.0005 parts of dioctyltin laurate were dissolved in a mixed solvent of 15 parts of methoxy propanol and 15 parts of tetrahydrofuran. To the resulting solution, a blocked isocyanate resin (BL3575: manufactured by Sumika Bayer Urethane Co., Ltd.) corresponding to 1.3 parts of solids was added to prepare a coating liquid for an undercoat layer. $R^{201}$ of the above formula (E-1) which is a characteristic moiety of the resin B23 represents a hydrogen atom.

The coating liquid for an undercoat layer was applied to the conductive layer by dip coating, and the resulting coating film was heated at 160° C. for 30 minutes to evaporate the solvent and cure the coating film to thereby form an undercoat layer having a thickness of 0.8 μm.

Next, a hydroxygallium phthalocyanine crystal (charge generating material) with a crystal form having peaks at Bragg angles)(2θ±0.2° of 7.5°, 9.9°, 12.5°, 16.3°, 18.6°, 25.1°, and 28.3° in CuKα characteristic X-ray diffraction was prepared. Ten parts of the hydroxygallium phthalocyanine crystal, 5 parts of polyvinyl butyral (trade name: S-LEC BX-1, manufactured by Sekisui Chemical Co., Ltd.) and 250 parts of cyclohexanone were charged into a sand mill containing glass beads having a diameter of 1 mm and subjected to dispersion treatment for 2 hours. Next, 250 parts of ethyl acetate was added to the resulting dispersion to prepare a coating liquid for a charge generating layer.

The coating liquid for a charge generating layer was applied to the undercoat layer by dip coating to form a coating film, and the resulting coating film was dried at 95° C. for 10 minutes to form a charge generating layer having a thickness of 0.17 μm.

Next, 8 parts of an amine compound (hole transport material) represented by the following formula (3), (3)

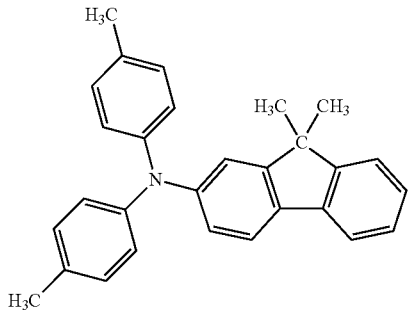

and 10 parts of a polyester resin (P1) having a weight average molecular weight (Mw) of 100,000 which has structural units represented by the following formulae (4) and (5) at a proportion of 5/5, (4)

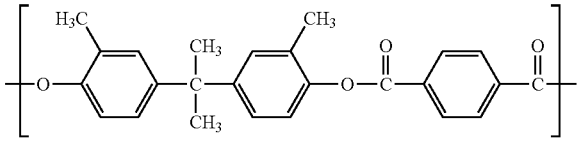

(5)

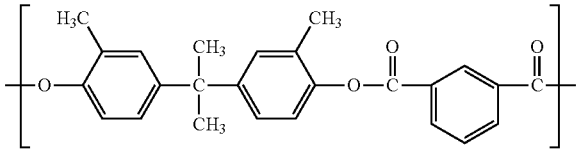

were dissolved in a mixed solvent of 40 parts of dimethoxymethane and 60 parts of chlorobenzene to thereby prepare a coating liquid for a hole transport layer.

The coating liquid for a hole transport layer was applied to the charge generating layer by dip coating, and the resulting coating film was dried at 120° C. for 40 minutes to thereby form a hole transport layer having a thickness of 15 μm.

In this way, an electrophotographic photosensitive member having a conductive layer, an undercoat layer, a charge generating layer, and a hole transport layer on a support was produced.

The electrophotographic photosensitive member produced was mounted on a modified machine (primary charging: roller contact DC charging, process speed: 120 mm/second, laser exposure) of a laser beam printer manufactured by Canon Inc. (trade name: LBP-2510) in an environment at a temperature of 23° C. and a humidity of 50% RH. Then, the initial surface potential and the surface potential after outputting 15,000 sheets of images were evaluated, and the output images were evaluated. Details will be described below.

(Evaluation of Surface Potential)

A cyan process cartridge of the laser beam printer was modified, and a potential probe (model 6000B-8: manufactured by TREK Japan KK) was mounted to the developing position. Next, the potential of the central portion of the electrophotographic photosensitive member was measured with a surface potential meter (model 344: manufactured by TREK Japan KK). Further, the amount of light of image exposure was set so that dark-area potential (Vd) might be −600 V and light-area potential (Vl) might be −150 V.

Subsequently, the electrophotographic photosensitive member produced was mounted on the cyan process cartridge of the laser beam printer, and the process cartridge was mounted on a cyan process cartridge station to output images.

Figure 2:
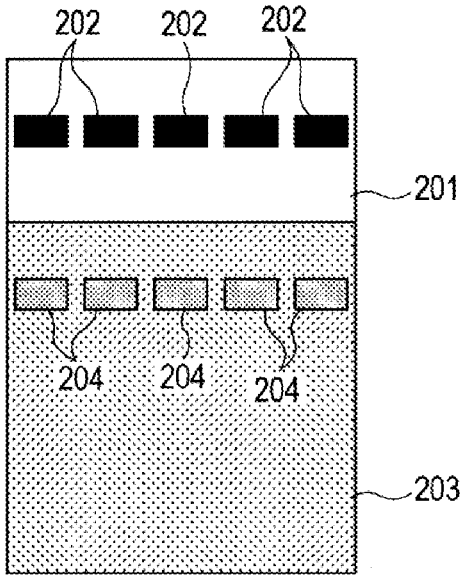
FIG. 2 is a diagram for describing an image for ghosting evaluation (printing for ghosting evaluation).
Figure 3:
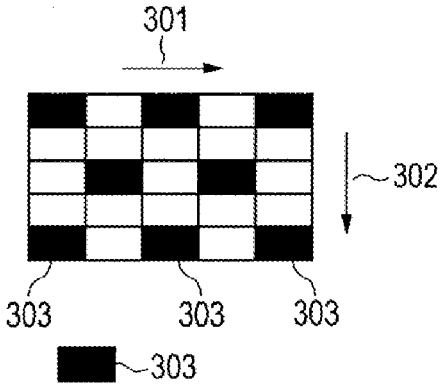
FIG. 3 is a diagram for describing a one-dot keima (similar to knight's move) pattern image.

First, a solid white image (1 sheet), images for ghosting evaluation (5 sheets), a solid black image (1 sheet) and images for ghosting evaluation (5 sheets) were continuously output in this order. As illustrated in FIG. 2, the image for ghost evaluation is an image in which quadrangular solid images 202 were output in a white image 201 at the upper portion of the image, and then a half-tone image 203 of a one-dot Keima pattern illustrated in FIG. 3 was prepared. In FIG. 3, reference numerals 301 and 302 denote a main scanning direction and a sub-scanning direction, respectively, and reference numeral 303 denotes 1 dot.

The positive ghosting was evaluated by measuring the density difference (Macbeth density difference) between the Macbeth density of the half-tone image 203 of the one-dot Keima pattern and the Macbeth density of ghosting portions 204 (portions in which positive ghosting can occur). The Macbeth density difference was measured at ten points in one sheet of the image for ghosting evaluation with a spectrodensitometer (trade name: X-Rite 504/508, manufactured by X-Rite Inc.). This operation was performed on all of the ten sheets of the images for ghosting evaluation, and the average of the results of the total of 100 points was calculated as a Macbeth density difference. Initial Macbeth density difference is shown in the column of "Macbeth density difference (initial)" in Table 11. The difference (variation) between the Macbeth density difference after outputting 15,000 sheets and the Macbeth density difference at the output of the initial image is shown in the column of "Macbeth density difference (variation)" in Table 11. The higher the density of the ghosting portion, the more strongly the positive ghosting has occurred. The smaller the density difference (Macbeth density difference), the more the positive ghosting has been suppressed.

Examples 2 to 49

Photosensitive members were prepared in the same manner as in Example 1 except that the type and parts by mass of the illustrated compound, crosslinking agent and resin were changed as shown in Table 11, and the evaluation of ghosting was also performed in the same manner. The results are shown in Table 11. $R^{201}$ of the above formula (E-1) which is a characteristic moiety of resin B1 represents $C_3H_7$. $R^{201}$ of the above formula (E-1) which is a $R^{205}$ characteristic moiety of resin B2 represents $C_3H_7$. $R^{202}$ to $R^{205}$ of the above formula (E-2) which are characteristic moieties of resin B8 represent hydrogen atoms. $R^{201}$ of the above formula (E-1) which is a characteristic moiety of resin B21 is $C_3H_7$. $R^{206}$ and $R^{207}$ of the above formula (E-3) which are characteristic moieties of resin B17 represent a phenyl group and an ethylene group, respectively.

Example 50

An electrophotographic photosensitive member was manufactured in the same manner as in Example 1 except that the conductive layer of Example 1 was changed as described below, and the evaluation of ghosting was also performed in the same manner. The results are shown in Table 11.

Two hundred and seven (207) parts of titanium oxide ($TiO_2$) particles coated with a phosphorus (P)-doped tin oxide ($SnO_2$), 144 parts of a phenolic resin (PLYOPHEN J-325) and 98 parts of 1-methoxy-2-propanol were charged into a sand mill containing 450 parts of glass beads having a diameter of 0.8 mm and subjected to dispersion treatment under conditions of a rotation speed of 2,000 rpm, a dispersion treatment time of 4.5 hours and a preset temperature of cooling water of 18° C. to obtain a dispersion. The glass beads were removed from the dispersion with a mesh (opening: 150 μm).

Silicone resin particles (trade name: Tospearl 120, manufactured by Momentive Performance Materials Inc., average particle size: 2 μm) were added to the dispersion so that the content of the silicone resin particles might be 15% by mass based on the total mass of the metal oxide particles and the binder resin in the dispersion obtained after removing the glass beads. Further, silicone oil (trade name: SH28PA, manufactured by Dow Corning Toray Co., Ltd.) was added to the dispersion so that the content of the silicone oil might be 0.01% by mass based on the total mass of the metal oxide particles and the binder resin in the dispersion, and the resulting dispersion was stirred to prepare a coating liquid for a conductive layer. The coating liquid for a conductive layer was applied to a support by dip coating, and the resulting coating film was dried and heat-cured at 150° C. for 30 minutes to form a conductive layer having a thickness of 30 μm.

Example 51

An electrophotographic photosensitive member was manufactured in the same manner as in Example 1 except that the conductive layer of Example 1 was changed as described below, and the evaluation of ghosting was also performed in the same manner. The results are shown in Table 11.

Two hundred and fourteen (214) parts of titanium oxide ($TiO_2$) particles coated with oxygen-deficient tin oxide ($SnO_2$), 132 parts of a phenolic resin (PLYOPHEN J-325) and 98 parts of 1-methoxy-2-propanol were charged into a sand mill containing 450 parts of glass beads having a diameter of 0.8 mm and subjected to dispersion treatment under conditions of a rotation speed of 2,000 rpm, a dispersion treatment time of 4.5 hours and a preset temperature of cooling water of 18° C. to obtain a dispersion. The glass beads were removed from the dispersion with a mesh (opening: 150 μm).

Silicone resin particles (Tospearl 120) were added to the dispersion so that the content of the silicone resin particles might be 10% by mass based on the total mass of the metal oxide particles and the binder resin in the dispersion obtained after removing the glass beads. Further, silicone oil (SH28PA) was added to the dispersion so that the content of the silicone oil might be 0.01% by mass based on the total mass of the metal oxide particles and the binder resin in the dispersion, and the resulting dispersion was stirred to prepare a coating liquid for a conductive layer. The coating liquid for a conductive layer was applied to a support by dip coating, and the resulting coating film was dried and heat-cured at 150° C. for 30 minutes to form a conductive layer having a thickness of 30 μm.

Example 52

An electrophotographic photosensitive member was manufactured in the same manner as in Example 1 except that the preparation of the coating liquid for a charge transport layer of Example 1 was changed as described below, and the evaluation of ghosting was also performed in the same manner. The results are shown in Table 11.

Nine (9) parts of the amine compound (hole transport material) represented by the formula (3), 1 part of an amine compound (hole transport material) represented by the following formula (6), and as a resin, 3 parts of a polyester resin (P2) (weight average molecular weight: 90,000) which has a structural unit represented by the following formula (7) and a structural unit represented by the following formula (8) at a ratio of 7:3, and further has a structural unit represented by the following formula (9), and 7 parts of a polyester resin (P1) were dissolved in a mixed solvent of 30 parts of dimethoxymethane and 50 parts of orthoxylene to prepare a coating liquid for a charge transport layer. The content of formula (9) is 10% by mass, and the total content of formula (7) and formula (8) is 90% by mass, based on the mass of the whole polyester resin (P2).

(6)

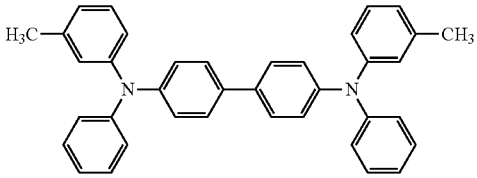

(7)

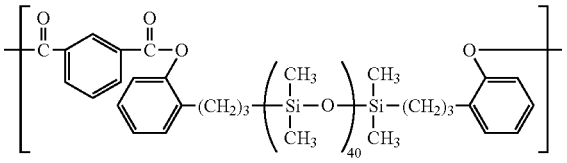

(8)

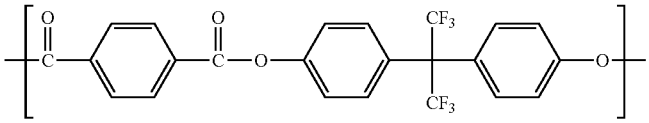

(9)

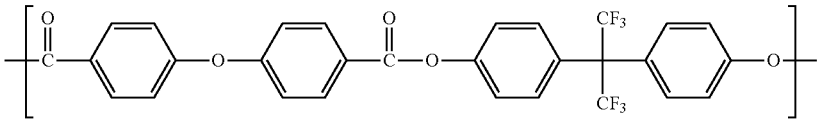

The coating liquid for a charge transport layer was applied to a charge generating layer by dip coating, and the resulting coating film was dried at 120° C. for 60 minutes to form a charge transport layer having a thickness of 15 μm. It was verified that, in the charge transport layer formed, a domain structure containing the polyester resin (P2) is contained in a matrix containing a charge transport material and the polyester resin (P1).

Example 53

An electrophotographic photosensitive member was manufactured in the same manner as in Example 1 except that the preparation of the coating liquid for a charge transport layer in Example 52 was changed as described below, and the evaluation of ghosting was also performed in the same manner. The results are shown in Table 11.

Nine (9) parts of the charge transport material represented by the formula (3), 1 part of a charge transport material represented by the formula (6), and as a resin, 10 parts of a polycarbonate resin P3 (weight average molecular weight: 70,000) which has a structural unit represented by the following formula (10), (10)

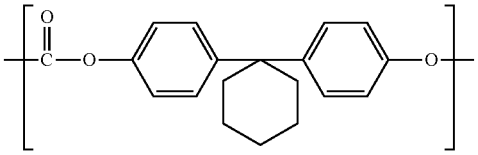

and 0.3 parts of a polycarbonate resin P4 (weight average molecular weight: 40,000) which has a structural unit represented by formula (10), a structural unit represented by the following formula (11) and a structure in which at least one of the terminals of the resin is represented by the following formula (12) were dissolved in a mixed solvent of 30 parts of dimethoxymethane and 50 parts of orthoxylene to prepare a coating liquid for a charge transport layer. In the polycarbonate resin P4, the total mass of the structural unit represented by formula (11) and the structure represented by formula (12) is 30% by mass based on the mass of the whole resin.

(11)

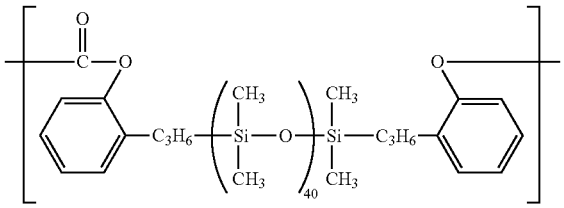

-continued (12)

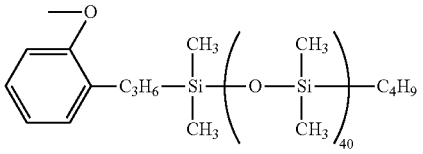

The coating liquid for a charge transport layer was applied to a charge generating layer by dip coating, and the resulting coating film was dried at 120° C. for 60 minutes to form a charge transport layer having a thickness of 15 μm.

Example 54

An electrophotographic photosensitive member was manufactured in the same manner as in Example 53 except that, in the preparation of the coating liquid for a charge transport layer in Example 53, 10 parts of the polycarbonate resin (P3) was replaced by 10 parts of the polyester resin (P1), and the evaluation of ghosting was also performed in the same manner. The results are shown in Table 11.

Example 55

An electrophotographic photosensitive member was manufactured in the same manner as in Example 54 except that 0.5 parts of the compound (E101) and 0.5 parts of a compound (E102) were used instead of 1 part of the compound (E101), and the evaluation of ghosting was also performed in the same manner. The results are shown in Table 11.

Example 56

An electrophotographic photosensitive member was manufactured in the same manner as in Example 54 except that 0.9 parts of the compound (E101) and 0.1 parts of a compound (E201) were used instead of 1 part of the compound (E101), and the evaluation of ghosting was also performed in the same manner. The results are shown in Table 11.

Example 57

An electrophotographic photosensitive member was manufactured in the same manner as in Example 54 except that 0.002 parts of a compound represented by the following formula (13) and 0.002 parts of a compound represented by the following formula (17) were added to the coating liquid for an undercoat layer, and the evaluation of ghosting was also performed in the same manner. The results are shown in Table 11.

(13)

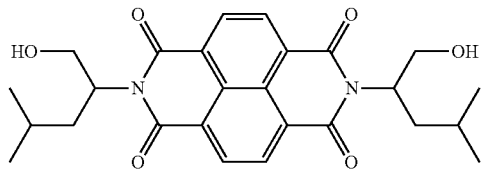

(17)

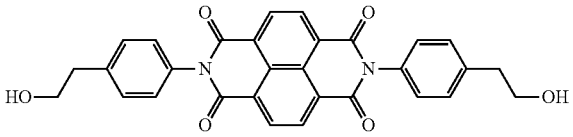

Example 58

An electrophotographic photosensitive member was prepared in the same manner as in Example 1 except that the aluminum cylinder was subjected to liquid honing treatment under the following conditions without forming a conductive layer, and the resulting cylinder was used as a support.

<Liquid Honing Conditions>

Polishing agent grains . . . zirconia beads, particle size: 70 to 125 μm (trade name: ZIRBLAST B120: manufactured by Material Science Co., Ltd.)

Suspending medium . . . water

Polishing agent/suspending medium=1/9 (volume ratio)

The cylinder surface roughness after honing was measured using a surface roughness measuring instrument SURFCORDER SE3500 of Kosaka Laboratory Ltd. according to JIS B 0601 (1994). The results were as follows: maximum height (RmaxD)=2.09 μm, ten-point average roughness (Rz)=1.48 μm, and arithmetic average roughness (Ra)=0.21 μm.

TABLE 11

| Example No. | Compound No. | Parts by mass | Crosslinking agent | Parts by mass | Parts by mass (solids) | Resin | Parts by mass | Macbeth density difference (initial) | Macbeth density difference (variation) |
|---|---|---|---|---|---|---|---|---|---|
| 1 | E101 | 1 | Crosslinking agent 1 | 1.7 | 1.3 | B23 | 0.2 | 0.028 | 0.010 |
| 2 | E102 | 1 | Crosslinking agent 1 | 1.7 | 1.3 | B23 | 0.2 | 0.030 | 0.009 |
| 3 | E103 | 1 | Crosslinking agent 1 | 1.8 | 1.4 | B23 | 0.2 | 0.032 | 0.010 |
| 4 | E104 | 1 | Crosslinking agent 1 | 1.7 | 1.3 | B23 | 0.2 | 0.030 | 0.012 |
| 5 | E105 | 1 | Crosslinking agent 1 | 1.7 | 1.3 | B23 | 0.2 | 0.031 | 0.010 |
| 6 | E107 | 1 | Crosslinking agent 1 | 1.7 | 1.3 | B23 | 0.2 | 0.030 | 0.011 |
| 7 | E108 | 1 | Crosslinking agent 1 | 1.7 | 1.3 | B23 | 0.2 | 0.030 | 0.010 |
| 8 | E110 | 1 | Crosslinking agent 1 | 1.7 | 1.3 | B23 | 0.2 | 0.029 | 0.010 |
| 9 | E111 | 1 | Crosslinking agent 1 | 1.7 | 1.3 | B23 | 0.2 | 0.030 | 0.009 |
| 10 | E112 | 1 | Crosslinking agent 1 | 1.8 | 1.4 | B23 | 0.2 | 0.032 | 0.012 |
| 11 | E117 | 1 | Crosslinking agent 1 | 1.7 | 1.3 | B23 | 0.2 | 0.030 | 0.011 |
| 12 | E122 | 1 | Crosslinking agent 1 | 1.7 | 1.3 | B23 | 0.2 | 0.029 | 0.010 |
| 13 | E127 | 1 | Crosslinking agent 1 | 1.7 | 1.3 | B23 | 0.2 | 0.030 | 0.009 |
| 14 | E129 | 1 | Crosslinking agent 1 | 1.7 | 1.3 | B23 | 0.2 | 0.031 | 0.010 |
| 15 | E130 | 1 | Crosslinking agent 1 | 1.6 | 1.2 | B23 | 0.3 | 0.030 | 0.011 |
| 16 | E137 | 1 | Crosslinking agent 1 | 1.6 | 1.2 | B23 | 0.3 | 0.032 | 0.014 |

TABLE 11-continued

| Example No. | Compound No. | Parts by mass | Crosslinking agent | Parts by mass | Parts by mass (solids) | Resin | Parts by mass | Macbeth density difference (initial) | Macbeth density difference (variation) |
|---|---|---|---|---|---|---|---|---|---|
| 17 | E138 | 1 | Crosslinking agent 1 | 1.6 | 1.2 | B23 | 0.3 | 0.030 | 0.016 |
| 18 | E143 | 1 | Crosslinking agent 1 | 1.7 | 1.3 | B23 | 0.2 | 0.030 | 0.016 |
| 19 | E145 | 1 | Crosslinking agent 1 | 1.7 | 1.3 | B23 | 0.2 | 0.031 | 0.018 |
| 20 | E146 | 1 | Crosslinking agent 1 | 1.6 | 1.2 | B23 | 0.3 | 0.030 | 0.018 |
| 21 | E113 | 1 | Crosslinking agent 1 | 1.7 | 1.3 | B23 | 0.2 | 0.035 | 0.010 |
| 22 | E116 | 1 | Crosslinking agent 1 | 1.8 | 1.4 | B23 | 0.2 | 0.036 | 0.011 |
| 23 | E121 | 1 | Crosslinking agent 1 | 1.6 | 1.2 | B23 | 0.2 | 0.035 | 0.010 |
| 24 | E141 | 1 | Crosslinking agent 1 | 1.7 | 1.3 | B23 | 0.2 | 0.037 | 0.016 |
| 25 | E201 | 1 | Crosslinking agent 1 | 1.7 | 1.3 | B23 | 0.2 | 0.030 | 0.023 |
| 26 | E204 | 1 | Crosslinking agent 1 | 1.7 | 1.3 | B23 | 0.2 | 0.030 | 0.023 |
| 27 | E301 | 1 | Crosslinking agent 1 | 1.7 | 1.3 | B23 | 0.2 | 0.031 | 0.026 |
| 28 | E302 | 1 | Crosslinking agent 1 | 1.7 | 1.3 | B23 | 0.2 | 0.030 | 0.025 |
| 29 | E401 | 1 | Crosslinking agent 1 | 1.7 | 1.3 | B23 | 0.2 | 0.030 | 0.026 |
| 30 | E404 | 1 | Crosslinking agent 1 | 1.7 | 1.3 | B23 | 0.2 | 0.029 | 0.025 |
| 31 | E101 | 1 | Crosslinking agent 2 | 2.9 | 2.2 | B1 | 0.5 | 0.039 | 0.010 |
| 32 | E101 | 1 | Crosslinking agent 2 | 2.7 | 2 | B1 | 0.5 | 0.030 | 0.010 |
| 33 | E101 | 1 | Crosslinking agent 2 | 1.7 | 1.3 | B1 | 0.2 | 0.030 | 0.009 |
| 34 | E101 | 1 | Crosslinking agent 2 | 0.5 | 0.4 | B1 | 0.1 | 0.031 | 0.011 |
| 35 | E104 | 1 | Crosslinking agent 3 | 1.7 | 1.3 | B2 | 0.2 | 0.030 | 0.010 |
| 36 | E105 | 1 | Crosslinking agent 3 | 1.7 | 1.3 | B8 | 0.2 | 0.030 | 0.010 |
| 37 | E110 | 1 | Crosslinking agent 4 | 1.3 | 1.3 | B21 | 0.2 | 0.031 | 0.010 |
| 38 | E101 | 1 | Crosslinking agent 5 | 1 | 1 | B1 | 0.5 | 0.030 | 0.011 |
| 39 | E102 | 1 | Crosslinking agent 5 | 1 | 1 | B1 | 0.5 | 0.029 | 0.009 |
| 40 | E105 | 1 | Crosslinking agent 5 | 1 | 1 | B1 | 0.5 | 0.030 | 0.010 |
| 41 | E108 | 1 | Crosslinking agent 5 | 1 | 1 | B1 | 0.5 | 0.030 | 0.011 |
| 42 | E116 | 1 | Crosslinking agent 5 | 1 | 1 | B1 | 0.5 | 0.035 | 0.012 |
| 43 | E139 | 1 | Crosslinking agent 5 | 1 | 1 | B1 | 0.5 | 0.030 | 0.016 |
| 44 | E124 | 1 | Crosslinking agent 5 | 1 | 1 | B1 | 0.5 | 0.030 | 0.023 |
| 45 | E201 | 1 | Crosslinking agent 6 | 1 | 1 | B1 | 0.5 | 0.031 | 0.024 |
| 46 | E202 | 1 | Crosslinking agent 6 | 1 | 1 | B1 | 0.5 | 0.036 | 0.023 |
| 47 | E208 | 1 | Crosslinking agent 6 | 1 | 1 | B17 | 0.5 | 0.030 | 0.023 |
| 48 | E102 | 1 | Crosslinking agent 5 | 0.4 | 0.4 | B8 | 0.2 | 0.030 | 0.010 |
| 49 | E101 | 1 | Crosslinking agent 7 | 1 | 1 | B1 | 0.5 | 0.030 | 0.010 |
| 50 | E101 | 1 | Crosslinking agent 1 | 1.7 | 1.3 | B23 | 0.2 | 0.029 | 0.009 |
| 51 | E101 | 1 | Crosslinking agent 1 | 1.7 | 1.3 | B23 | 0.2 | 0.031 | 0.010 |
| 52 | E101 | 1 | Crosslinking agent 1 | 1.7 | 1.3 | B23 | 0.2 | 0.030 | 0.010 |
| 53 | E101 | 1 | Crosslinking agent 1 | 1.7 | 1.3 | B23 | 0.2 | 0.031 | 0.011 |
| 54 | E101 | 1 | Crosslinking agent 1 | 1.7 | 1.3 | B23 | 0.2 | 0.030 | 0.010 |
| 55 | E101/E102 | 0.5/0.5 | Crosslinking agent 1 | 1.7 | 1.3 | B23 | 0.2 | 0.031 | 0.011 |
| 56 | E101/E201 | 0.9./0.1 | Crosslinking agent 1 | 1.7 | 1.3 | B23 | 0.2 | 0.030 | 0.012 |
| 57 | E101/(13)/(17) | 1/0.002/0.002 | Crosslinking agent 1 | 1.7 | 1.3 | B23 | 0.2 | 0.031 | 0.010 |
| 58 | E101 | 1 | Crosslinking agent 1 | 1.7 | 1.3 | B23 | 0.2 | 0.030 | 0.010 |

In Table 11, the crosslinking agent 1 is an isocyanate crosslinking agent (trade name: Desmodur BL3575, manufactured by Sumika Bayer Urethane Co., Ltd. (solid content: 75%)). The crosslinking agent 2 is an isocyanate crosslinking agent (trade name: Desmodur BL3175, manufactured by Sumika Bayer Urethane Co., Ltd. (solid content: 75%)). The crosslinking agent 3 is an isocyanate crosslinking agent (trade name: Desmodur BL3475, manufactured by Sumika Bayer Urethane Co., Ltd. (solid content: 75%)). The crosslinking agent 4 is 1-methylbenzene-2,2,4,6-triyl triisocyanate (manufactured by Sigma-Aldrich Japan, K.K.). The crosslinking agent 5 is a butyrated melamine crosslinking agent (trade name: SUPER BECKAMINE J821-60, manufactured by DIC Corporation (solid content: 60%)). The crosslinking agent 6 is a butyrated urea crosslinking agent (trade name: BECKAMINE P138, manufactured by DIC Corporation (solid content: 60%)). The crosslinking agent 7 is 2,4,6-tris[bis(methoxymethyl)amino]-1,3,5-triazine (manufactured by Tokyo Chemical Industry Co., Ltd.).

Comparative Example 1

An electrophotographic photosensitive member was manufactured in the same manner as in Example 1 except that an undercoat layer was formed using a compound represented by the following formula (14) (illustrated compound (11-6) described in Japanese Patent Application Laid-Open No. 2008-250082) and an isocyanate compound (a copolymer with styrene having 5% by mole of a unit represented by the following formula (15) described in Japanese Patent Application Laid-Open No. 2008-250082: weight average molecular weight Mw: 42,000), and the evaluation of ghosting was also performed in the same manner.

The Macbeth density difference (initial) at the output of the initial image was found to be 0.048, and the difference (variation) between the Macbeth density difference after outputting 15,000 sheets and the Macbeth density difference at the output of the initial image was found to be 0.061.

(14)

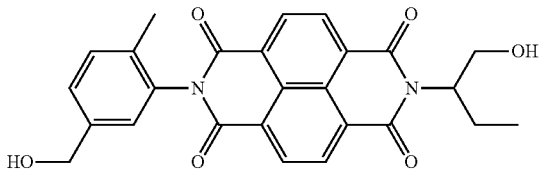

(15)

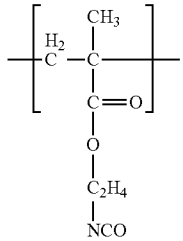

Comparative Example 2

An electrophotographic photosensitive member was manufactured in the same manner as in Example 1 except that an undercoat layer was formed using a phenolic resin (trade name: PL-4804, manufactured by Gun Ei Chemical Industry Co., Ltd.) and a compound represented by the following formula (16), and the evaluation of ghosting was also performed in the same manner.

The Macbeth density difference (initial) at the output of the initial image was found to be 0.046, and the difference (variation) between the Macbeth density difference after outputting 15,000 sheets and the Macbeth density difference at the output of the initial image was found to be 0.072.

(16)

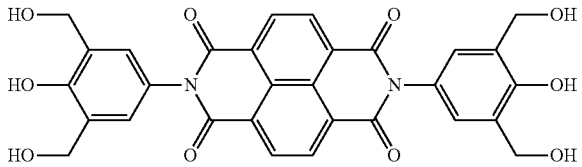

Example 59

An electrophotographic photosensitive member was manufactured in the same manner as in Comparative Example 1 except that the compound represented by formula (14) was changed to the compound (E101), and the evaluation of ghosting was also performed in the same manner.

The Macbeth density difference (initial) at the output of the initial image was found to be 0.037, and the difference (variation) between the Macbeth density difference after outputting 15,000 sheets and the Macbeth density difference at the output of the initial image was found to be 0.034.

Reference Example 1

A photosensitive member was prepared in the same manner as in Example 1 except that the compound (E101) was changed to a compound represented by the following formula (RE1), and the type and parts by mass of the crosslinking agent and resin were changed as shown in Table 12, and the evaluation of ghosting was also performed in the same manner. The results are shown in Table 12.

(RE1)

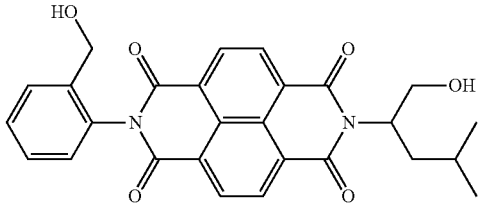

Reference Example 2

A photosensitive member was prepared in the same manner as in Example 1 except that the compound (E101) was changed to a compound represented by the following formula (RE2), and the type and parts by mass of the crosslinking agent and resin were changed as shown in Table 12, and the evaluation of ghosting was also performed in the same manner. The results are shown in Table 12.

(RE2)

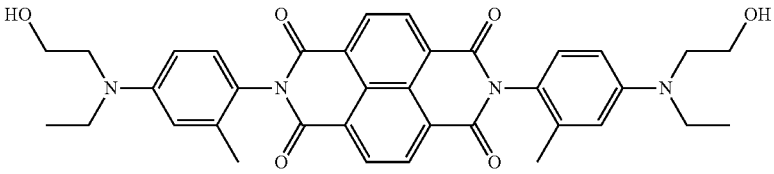

Reference Example 3

A photosensitive member was prepared in the same manner as in Example 1 except that the compound (E101) was changed to a compound represented by the following formula (RE3), and the type and parts by mass of the crosslinking agent and resin were changed as shown in Table 12, and the evaluation of ghosting was also performed in the same manner. The results are shown in Table 12.

(RE3)

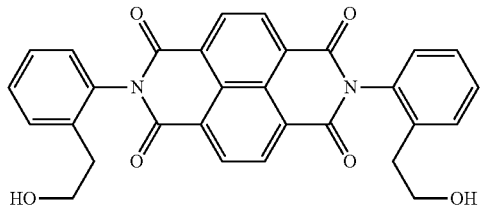

TABLE 12

| Reference Example No. | Compound No. | Parts by mass | Crosslinking agent | Parts by mass | Parts by mass (solids) | Resin | Parts by mass | Macbeth density difference (initial) | Macbeth density difference (variation) |
|---|---|---|---|---|---|---|---|---|---|
| 1 | RE1 | 1 | Crosslinking agent 2 | 1.9 | 1.4 | B1 | 0.2 | 0.040 | 0.038 |
| 2 | RE2 | 1 | Crosslinking agent 2 | 1.8 | 1.3 | B1 | 0.2 | 0.041 | 0.036 |
| 3 | RE3 | 1 | Crosslinking agent 2 | 1.7 | 1.3 | B1 | 0.2 | 0.042 | 0.035 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270571, filed Dec. 26, 2013, and Japanese Patent Application No. 2014-240042, filed Nov. 27, 2014, which are hereby incorporated by reference herein in their entirety.

What is claimed is:

1. An electrophotographic photosensitive member comprising:

a support;

an undercoat layer formed on the support; and a photosensitive layer formed on the undercoat layer;

wherein the undercoat layer comprises a polymerized product of a composition comprising an imide compound represented by the following formula (1), (1)

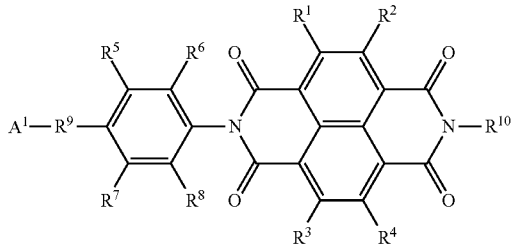

wherein $R^1$ to $R^4$ each independently represent a hydrogen atom, a cyano group, a nitro group, a halogen atom, a substituted or unsubstituted alkyl group, or a substituted or unsubstituted aryl group, $R^5$ to $R^8$ each independently represent a hydrogen atom, a halogen atom, a nitro group, or a substituted or unsubstituted alkyl group, $A^1$ represents a hydroxy group, a thiol group, an amino group, or a carboxy group, $R^9$ represents an unsubstituted or substituted alkylene group where the distance to $A^1$ is 2 to 6 atoms, a group where the distance to $A^1$ is 2 to 6 atoms, which is derived from substitution of CONH for one of the $CH_2$'s in the main chain of an unsubstituted or substituted alkylene group, or a group where the distance to $A^1$ is 2 to 6 atoms, which is derived from substitution of $NR^{11}$ for one of the $CH_2$'s in the main chain of an unsubstituted or substituted alkylene group, a substituent of the substituted alkylene group is an alkyl group having 1 to 4 carbon atoms, $R^{11}$ represents an alkyl group, $R^{10}$ represents a group represented by —$R^{12}$-$A^2$, $A^2$ represents a hydroxy group, a thiol group, an amino group, or a carboxy group, $R^{12}$ represents an unsubstituted or substituted alkylene group where the distance to $A^2$ is 2 to 12 atoms, a group where the distance to $A^2$ is 2 to 12 atoms, which is derived from substitution of an oxygen atom for one of the $CH_2$'s in the main chain of an unsubstituted or substituted alkylene group, a group where the distance to $A^2$ is 2 to 12 atoms, which is derived from substitution of a sulfur atom for one of the $CH_2$'s in the main chain of an unsubstituted or substituted alkylene group, or a group where the distance to $A^2$ is 2 to 12 atoms, which is derived from substitution of $NR^{13}$ for one of the $CH_2$'s in the main chain of an unsubstituted or substituted alkylene group, a substituent of the substituted alkylene group is an alkyl group having 1 to 6 carbon atoms, a phenyl group, a benzyl group, or an alkoxycarbonyl group, and $R^{13}$ represents a hydrogen atom, or an alkyl group.

2. The electrophotographic photosensitive member according to claim 1, wherein $R^9$ of the formula (1) represents an ethylene group, a propylene group or a butylene group.

3. The electrophotographic photosensitive member according to claim 1, wherein $R^{12}$ of the formula (1) represents a substituted alkylene group where the distance to $A^2$ is 2 to 12 atoms.

4. The electrophotographic photosensitive member according to claim 1, wherein $A^1$ and $A^2$ represent hydroxy groups.

5. The electrophotographic photosensitive member according to claim 1, wherein the composition comprising the compound represented by the formula (1) further comprises a crosslinking agent.

6. The electrophotographic photosensitive member according to claim 5, wherein the composition further comprises a resin having a polymerizable functional group.

7. The electrophotographic photosensitive member according to claim 6, wherein the polymerizable functional group of the resin is a hydroxy group, a thiol group, an amino group, a carboxy group or a methoxy group.

8. The electrophotographic photosensitive member according to claim 5, wherein the crosslinking agent is:

an isocyanate compound having an isocyanate group or a blocked isocyanate group; or an amine compound having an N-methylol group or an alkyl-etherified N-methylol group.

9. The electrophotographic photosensitive member according to claim 5, wherein the mass ratio of the crosslinking agent to the compound represented by the formula (1) is in the range of 100:50 to 100:250.

10. A process cartridge detachably attachable to a main body of an electrophotographic apparatus, wherein the process cartridge integrally supports: the electrophotographic photosensitive member according to claim 1; and at least one device selected from the group consisting of a charging device, a developing device and a cleaning device.

11. An electrophotographic apparatus having the electrophotographic photosensitive member according to claim 1, a charging device, an image exposure device, a developing device and a transfer device.

12. An imide compound represented by formula (1), (1)

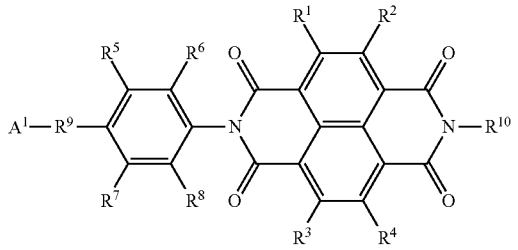

wherein $R^1$ to $R^4$ each independently represent a hydrogen atom, a cyano group, a nitro group, a halogen atom, a substituted or unsubstituted alkyl group, or a substituted or unsubstituted aryl group, $R^5$ to $R^8$ each independently represent a hydrogen atom, a halogen atom, a nitro group, or a substituted or unsubstituted alkyl group, $A^1$ represents a hydroxy group, a thiol group, an amino group, or a carboxy group, $R^9$ represents an unsubstituted or substituted alkylene group where the distance to $A^1$ is 2 to 6 atoms, a group where the distance to $A^1$ is 2 to 6 atoms, which is derived from substitution of CONH for one of the $CH_2$'s in the main chain of an unsubstituted or substituted alkylene group, or a group where the distance to $A^1$ is 2 to 6 atoms, which is derived from substitution of $NR^{11}$ for one of the $CH_2$'s in the main chain of an unsubstituted or substituted alkylene group, a substituent of the substituted alkylene group is an alkyl group having 1 to 4 carbon atoms, $R^{11}$ represents an alkyl group, $R^{10}$ represents a group represented by —$R^{12}$-$A^2$, $A^2$ represents a hydroxy group, a thiol group, an amino group, or a carboxy group, $R^{12}$ represents an unsubstituted or substituted alkylene group where the distance to $A^2$ is 2 to 12 atoms, a group where the distance to $A^2$ is 2 to 12 atoms, which is derived from substitution of an oxygen atom for one of the $CH_2$'s in the main chain of an unsubstituted or substituted alkylene group, a group where the distance to $A^2$ is 2 to 12 atoms, which is derived from substitution of a sulfur atom for one of the $CH_2$'s in the main chain of an unsubstituted or substituted alkylene group, or a group where the distance to $A^2$ is 2 to 12 atoms, which is derived from substitution of $NR^{13}$ for one of the $CH_2$'s in the main chain of an unsubstituted or substituted alkylene group, a substituent of the substituted alkylene group is an alkyl group having 1 to 6 carbon atoms, a phenyl group, a benzyl group, or an alkoxycarbonyl group, and $R^{13}$ represents a hydrogen atom, or an alkyl group.

* * * * *